US011330857B2

(12) United States Patent
Teetzel et al.

(10) Patent No.: US 11,330,857 B2
(45) Date of Patent: May 17, 2022

(54) HELMET MOUNT INTERFACE APPARATUSES AND METHODS

(71) Applicant: Wilcox Industries Corp., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 21 days.

(21) Appl. No.: 16/156,470

(22) Filed: Oct. 10, 2018

(65) Prior Publication Data

US 2019/0104797 A1 Apr. 11, 2019

Related U.S. Application Data

(60) Provisional application No. 62/570,583, filed on Oct. 10, 2017.

(51) Int. Cl.

| | |
|---|---|
| ***A42B 3/04*** | (2006.01) |
| ***F41H 1/04*** | (2006.01) |
| *A42B 3/30* | (2006.01) |
| *A42B 3/06* | (2006.01) |
| *F41G 11/00* | (2006.01) |

(52) U.S. Cl.

CPC ..... *A42B 3/0406* (2013.01); *A42B 3/04* (2013.01); *F41H 1/04* (2013.01); *A42B 3/063* (2013.01); *A42B 3/30* (2013.01); *F41G 11/001* (2013.01)

(58) Field of Classification Search

CPC ..... A42B 3/0406; A42B 3/04; A42B 3/30; A42B 3/063; F41H 1/04; F41G 11/001

USPC ..... 2/421; 248/683, 467, 205.3, 317

See application file for complete search history.

(56) References Cited

U.S. PATENT DOCUMENTS

| | | | | |
|---|---|---|---|---|
| 1,658,573 | A * | 2/1928 | Roper | A44B 1/30 40/1.5 |
| 5,913,480 | A | 6/1999 | Luhmann et al. | |
| 6,457,838 | B1 | 10/2002 | Dugmore et al. | |
| 7,004,439 | B1 | 2/2006 | Taylor et al. | |
| 7,524,153 | B2 | 4/2009 | Hoy | |
| 7,584,582 | B1 * | 9/2009 | Hutter, III | B64C 1/40 156/91 |
| 8,028,344 | B2 | 10/2011 | Rogers et al. | |
| 8,689,409 | B2 * | 4/2014 | Hanley | E04F 13/0885 24/457 |
| 9,770,060 | B2 * | 9/2017 | Infusino | A63B 71/10 |
| 9,872,531 | B2 | 1/2018 | Uke et al. | |

(Continued)

*Primary Examiner* — Muhammad Ijaz

(74) *Attorney, Agent, or Firm* — McLane Middleton, Professional Association

(57) ABSTRACT

A modular helmet interface with a mounting cleat, threaded insert, and adhesive layer is provided. In one aspect, a mounting cleat is affixed to a helmet, such as a ballistic helmet, by an adhesive layer, the mounting cleat having an outer portion and a threaded insert within a cavity formed in the outer portion. The outer portion has an inward facing surface configured to receive an adhesive layer for coupling the inward facing surface to the helmet surface. In another aspect, a mounting cleat is secured to a helmet by way of a cleat-receiving securing member, the securing member affixed to the helmet by an adhesive layer. In a more limited aspect, a helmet having multiple mounting cleats configured to support an accessory mounting rail or a helmet mount assembly.

48 Claims, 44 Drawing Sheets

(56) References Cited

U.S. PATENT DOCUMENTS

| | | | | |
|---|---|---|---|---|
| 10,258,100 | B1 * | 4/2019 | Erb | A42B 3/128 |
| 10,383,387 | B2 | 8/2019 | Gendron et al. | |
| 2008/0000015 | A1 * | 1/2008 | Sutter | A42B 3/04 2/410 |
| 2010/0012692 | A1 | 1/2010 | Harris et al. | |
| 2014/0084118 | A1 * | 3/2014 | Tooley | F16B 11/00 248/205.3 |
| 2014/0223643 | A1 * | 8/2014 | Infusino | A63B 71/081 2/413 |
| 2015/0040967 | A1 * | 2/2015 | West | H02S 20/24 136/251 |
| 2015/0351482 | A1 | 12/2015 | Gendron et al. | |
| 2016/0161222 | A1 * | 6/2016 | Lee | A42B 3/14 2/416 |
| 2018/0109006 | A1 * | 4/2018 | Ng | H01Q 1/42 |
| 2019/0098952 | A1 | 4/2019 | Teetzel et al. | |
| 2019/0104797 | A1 | 4/2019 | Teetzel et al. | |
| 2019/0107247 | A1 | 4/2019 | Teetzel et al. | |

* cited by examiner

HELMET MOUNT INTERFACE APPARATUSES AND METHODS

CROSS REFERENCE TO RELATED APPLICATIONS

This application claims the priority benefit of U.S. provisional patent application No. 62/570,583, filed Oct. 10, 2017, entitled "Helmet Mount Interface Apparatuses and Methods." The aforementioned application is incorporated herein by reference in its entirety.

INCORPORATION BY REFERENCE

This application is related to U.S. provisional patent application No. 62/567,923 filed Oct. 4, 2017, entitled "Modular Helmet Interface," U.S. nonprovisional application Ser. No. 16/151,899 filed Oct. 4, 2018, entitled "Modular Helmet Interface," U.S. provisional patent application No. 62/568,934 filed Oct. 6, 2017, entitled "Modular Helmet Interface with Threaded Insert," U.S. provisional patent application No. 62/570,592 filed Oct. 10, 2017, entitled "Modular Helmet Interface with Threaded Insert," and U.S. nonprovisional application Ser. No. 16/155,328 filed Oct. 9, 2018, entitled "Modular Helmet Interface with Threaded Insert." Each of the foregoing applications is incorporated herein by reference in its entirety.

BACKGROUND

The present disclosure relates to a modular interface for a helmet and, in particular, to a modular helmet mount system to accommodate the mounting of various accessory devices to a protective helmet such as a ballistic combat helmet or other protective helmet or headgear.

Prior art helmet mounting systems commonly rely on one or more holes formed in the helmet for attaching a night vision mounting system. Exemplary hole patterns include single-hole patterns, such as the Standard One-Hole pattern, multiple-hole patterns, such as the Standard Three-Hole pattern.

Ballistic helmets derive their ballistic protection from a shell formed of highly consolidated layers of polymer impregnated aramid fiber (e.g., Kevlar fabric impregnated with a polyvinyl butyral (PVB)-phenolic resin). When one or more holes are drilled in the shell, the ballistic integrity is compromised, both because of the voids such holes create in the ballistic structure, as well as because of the ability of moisture to infiltrate the composite material at the site of the hole and cause separation of the ballistic plies over time.

When holes are drilled in the ballistic shell, the ballistic integrity of the shell may be compromised. This can be mitigated somewhat when the holes are drilled by the manufacturer at the factory before the shells are sprayed with a sealant finish to insure the holes are sealed from moisture, which would otherwise cause the ballistic fabric layers to separate over time and lose their ballistic protective properties. Nonetheless, even when properly sealed at the factory, the underlying ballistic structure of the helmet is weakened where the holes are drilled and must be mitigated by the use of ballistic grade mounting hardware, including, e.g., the threaded inserts bonded into the holes by the manufacturer and ballistic screws used for securing hardware to the helmet, even when the holes are not being used.

Sometimes it is desired to attach mounting hardware to a helmet that has been predrilled with a hole pattern differing from the hole pattern of the mounting hardware. In such cases, a user will drill new holes to accommodate the mounting hardware. Drilling new holes disrupts the sealant finish on the helmet, which may allow the ballistic fabric layers to separate due to moisture absorption, and weakens the composite structure of the helmet. When holes are drilled by the end user, there is also a risk that the holes may not be in the correct position on the helmet.

The present disclosure contemplates a new and improved helmet mounting interface and method which does not require holes to be drilled in the ballistic shell of the helmet.

SUMMARY

In one aspect, a helmet mount system for attaching a device to a helmet comprises a mounting cleat having an outer portion and a threaded insert within a cavity formed in the outer portion. The outer portion has an inward facing surface configured to receive an adhesive layer for coupling the inward facing surface to the helmet surface.

In another aspect, a helmet mount system for attaching a device to a helmet comprises one or more mounting cleats, each of the one or more mounting cleats having an outer portion and a threaded insert received within a cavity formed in the outer portion. The outer portion of the mounting cleats have inward facing surfaces configured to receive an adhesive layer for coupling the inward facing surface to a surface of the helmet.

In yet another aspect, a helmet mount system for attaching a device to a helmet comprises a mounting cleat, the mounting cleat having an outer portion and a threaded insert received within a cavity formed in the outer portion. The outer portion has an inward facing surface configured to receive an adhesive layer for coupling the inward facing surface to a surface of the helmet. A securing member has a back surface, the back surface configured to couple to a surface of the helmet via an adhesive bond.

One advantage of the present development is that it does not require holes to be drilled through the ballistic shell of the helmet, thereby maintaining ballistic integrity of the helmet.

Another advantage resides in adaptability for interchangeably attaching a variety of devices to be mounted, including without limitation, night vision devices, battery packs, illuminating devices, friend foe systems, rail-type accessory mounts including Picatinny, NATO Accessory Rail (NAR), Standardization Agreement (STANAG) 2324 rail, MIL-STD 1913 rail, and other rail-type mounts, to provide a modular helmet system.

Another advantage of the present helmet mounting interface system is that it is independent of the helmet material and the geometric shape and size of the helmet.

Still another advantage of the present system resides in its relatively low profile, which reduces the snag hazards associated with the mounting interface, and which snag hazard is further mitigated with removable covers.

Yet another advantage of the present development is that it is readily amenable to standardization, which enables it to define a common interface that multiple manufactures can design to, thereby further increasing the modularity of the system and the range of accessory options available. Just as the Picatinny weapon rail interface standard has greatly increased intercompatibility among weapon-mounted accessory devices, it is contemplated that the present development can be standardized to increase intercompatibility among helmet-mounted accessory devices.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

FIGS. 11 and 12 illustrate a preferred configuration for mounting a shroud (for example, a shroud of the type providing helmet mount interface, e.g., for a night vision device or other viewing device) on the forward portion of the helmet and battery compartment dock on the aft portion of the helmet, wherein there are two cleats forward and two cleats aft.

FIGS. 23A and 23B illustrate a preferred configuration for mounting accessory rail members (for example, an accessory rail of the type providing an accessory interface portion, e.g., for night vision devices, battery packs, illuminating devices, friend-or-foe systems, or the like) on the left and right side portions of the helmet, wherein there are two cleats on each side.

FIGS. 25A and 25B illustrate a preferred configuration for mounting a shroud (for example, a shroud of the type providing helmet mount interface, e.g., for a night vision device or other viewing device) on the forward portion of the helmet and battery compartment dock on the aft portion of the helmet, wherein there are two cleats forward and two cleats aft.

DETAILED DESCRIPTION OF THE PREFERRED EMBODIMENTS

Figure 1:
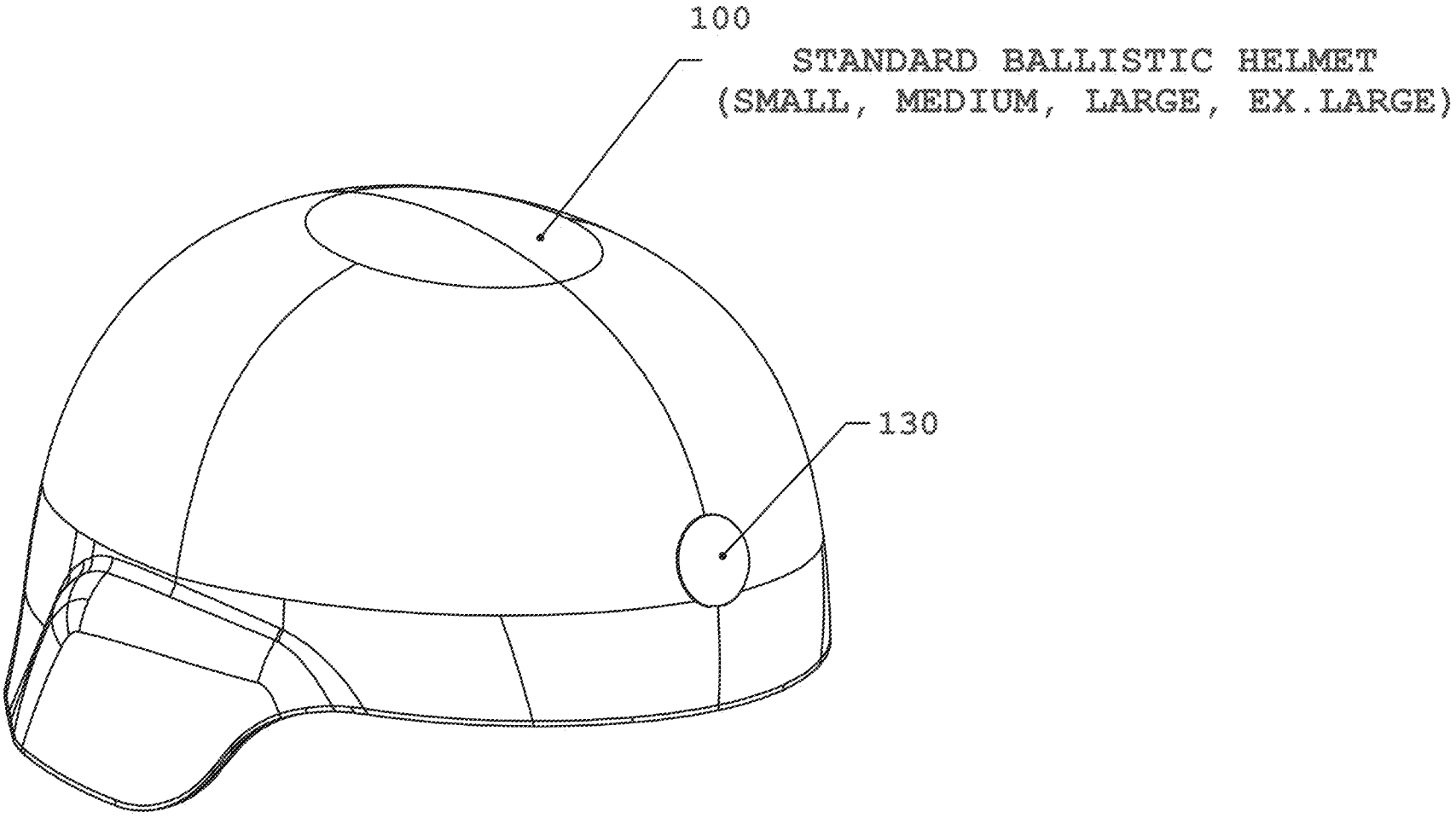
FIG. 1 is an isometric view of a helmet mount system according to a first exemplary embodiment.

Referring now to the drawings, FIG. 1 is an isometric view of an exemplary helmet 100 having one mounting cleat 110 in accordance with this disclosure attached to the front and central portion of the helmet. In certain embodiments, the cleat design appearing in FIG. 1 is formed of hard coated aluminum or a molded polymer with a threaded insert. It will be recognized that the illustrated embodiment is exemplary only and that the embodiment of FIG. 1 can be adapted for positioning at any one or more locations on the helmet, including, for example, the rear, side(s), top, and elsewhere. In certain embodiments, the illustrated helmet 100 is a military combat helmet such as a ballistic fiber combat helmet (e.g., Advanced Combat Helmet (ACH)), although protective helmets formed of other materials such as thermoplastics, metals, etc., are also contemplated.

Although the present development will be shown by way of reference to mounting cleats attached to the exterior surface of the helmet, it is also contemplated that the cleats herein could also be attached to an interior surface of the helmet for attaching interior components of the helmet, such as cushions, suspension webbing, chin straps, nape straps, sweatbands, communications devices, and so forth.

Figure 1A:
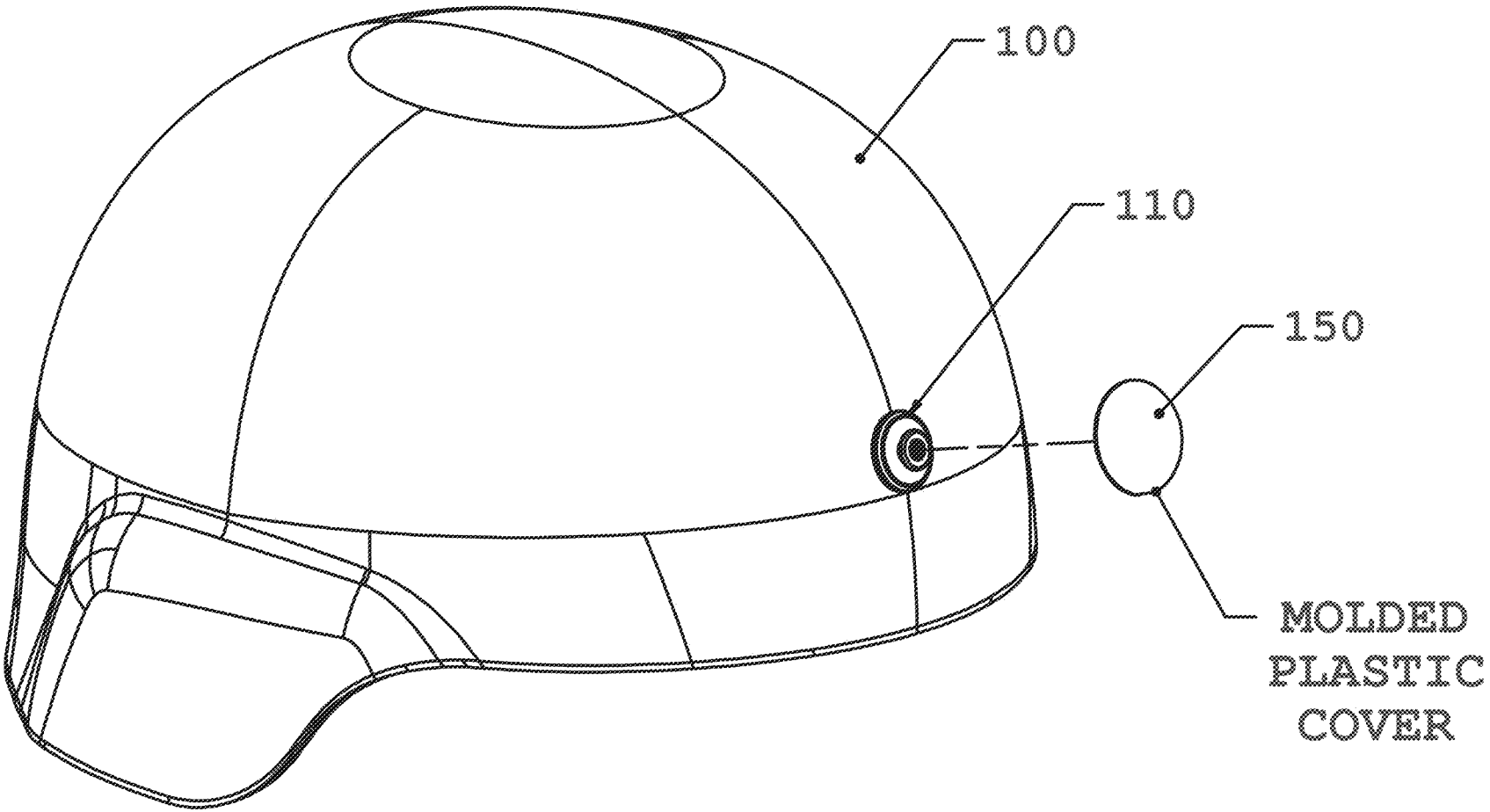
FIG. 1A is a partially exploded view of the embodiment appearing in FIG. 1.
Figure 2:
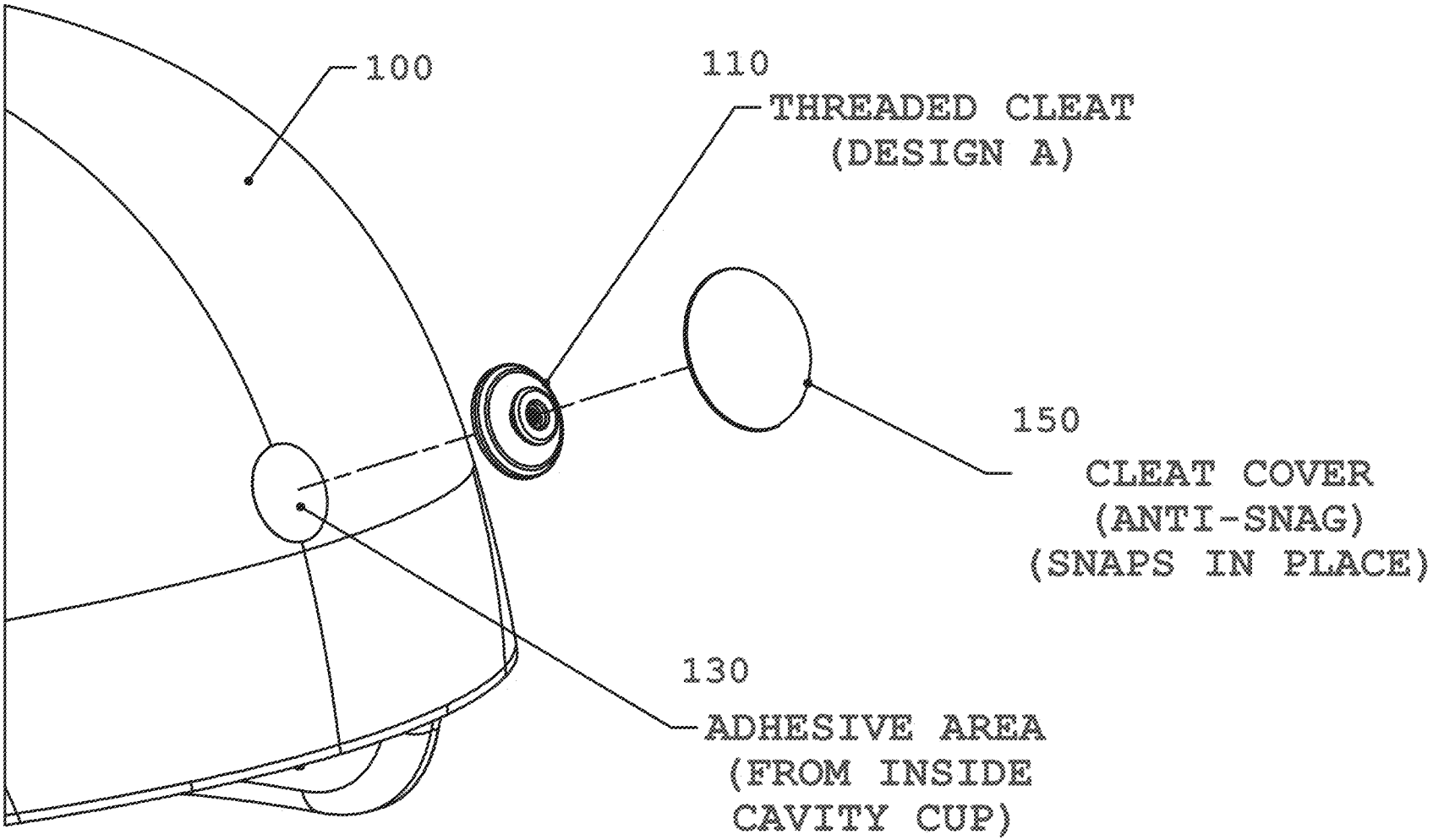
FIG. 2 is a partially exploded view of the embodiment appearing in FIG. 1.

FIG. 2 is a fragmentary, exploded view of the helmet and cleat system appearing in FIG. 1. The cleat system includes the cleat 110, which is secured to the helmet surface with an adhesive 130. The cleat system may further include an optional cover 150. FIG. 1A is an isometric view of the helmet 100 which is similar to the view seen in FIG. 1, with the cover removed.

Figure 3:
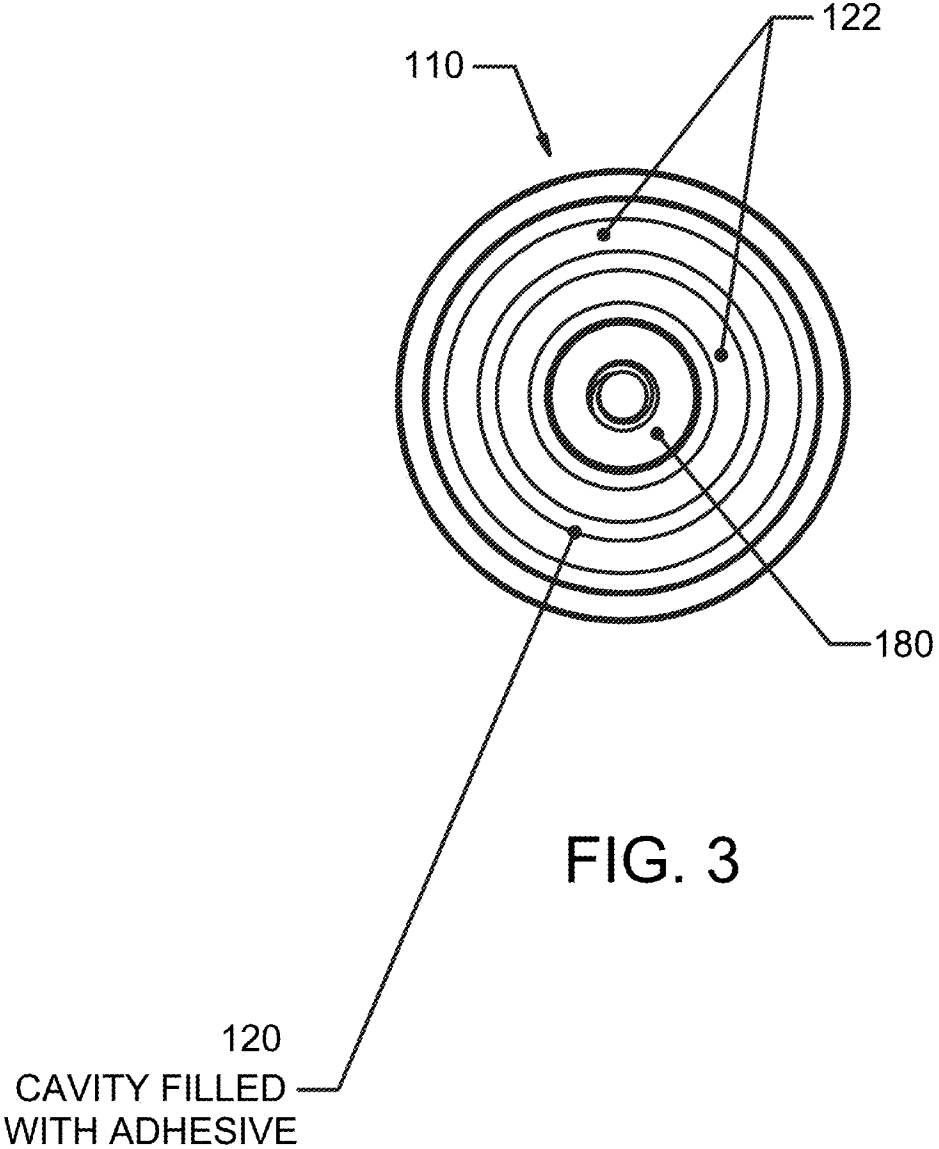
FIG. 3 is a bottom view of the mounting cleat portion of the embodiment appearing in FIG. 1.
Figure 4:
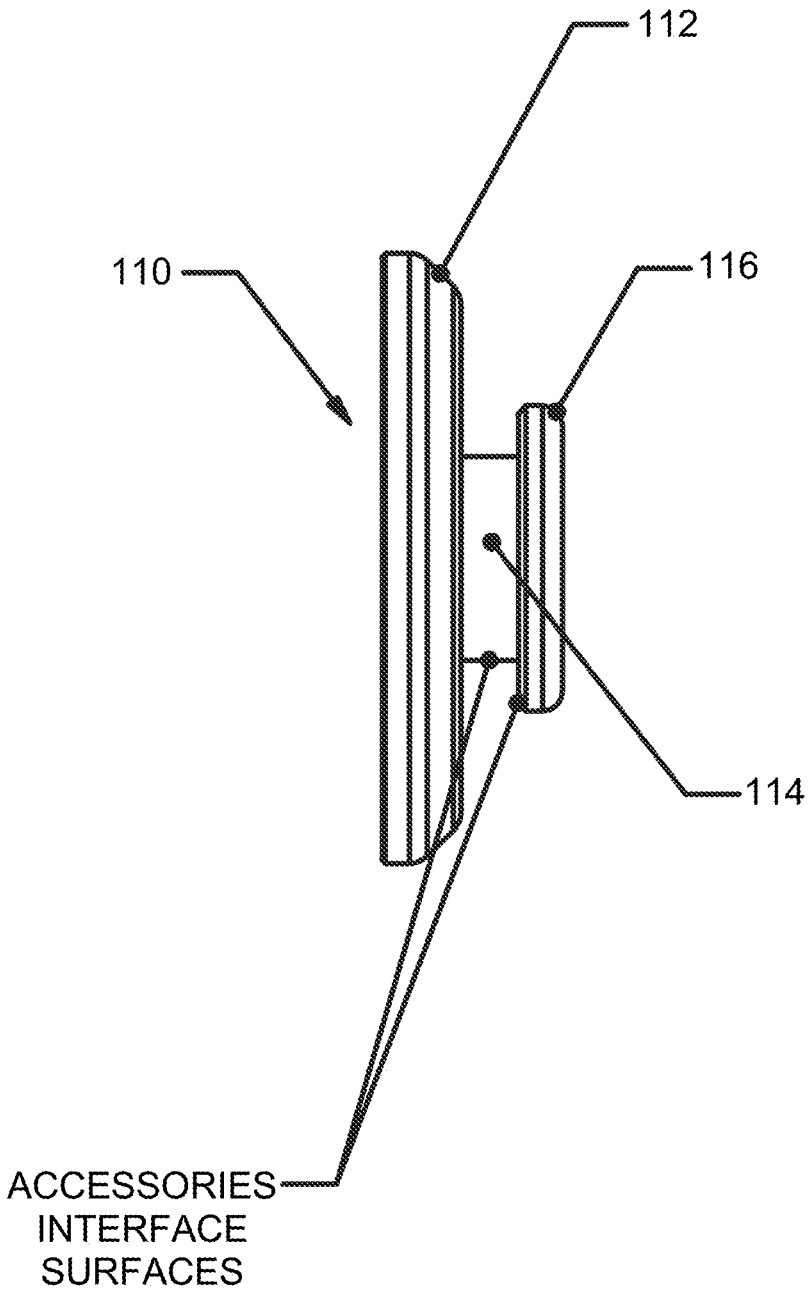
FIG. 4 is a side view of the mounting cleat portion appearing in FIG. 3.
Figure 5:
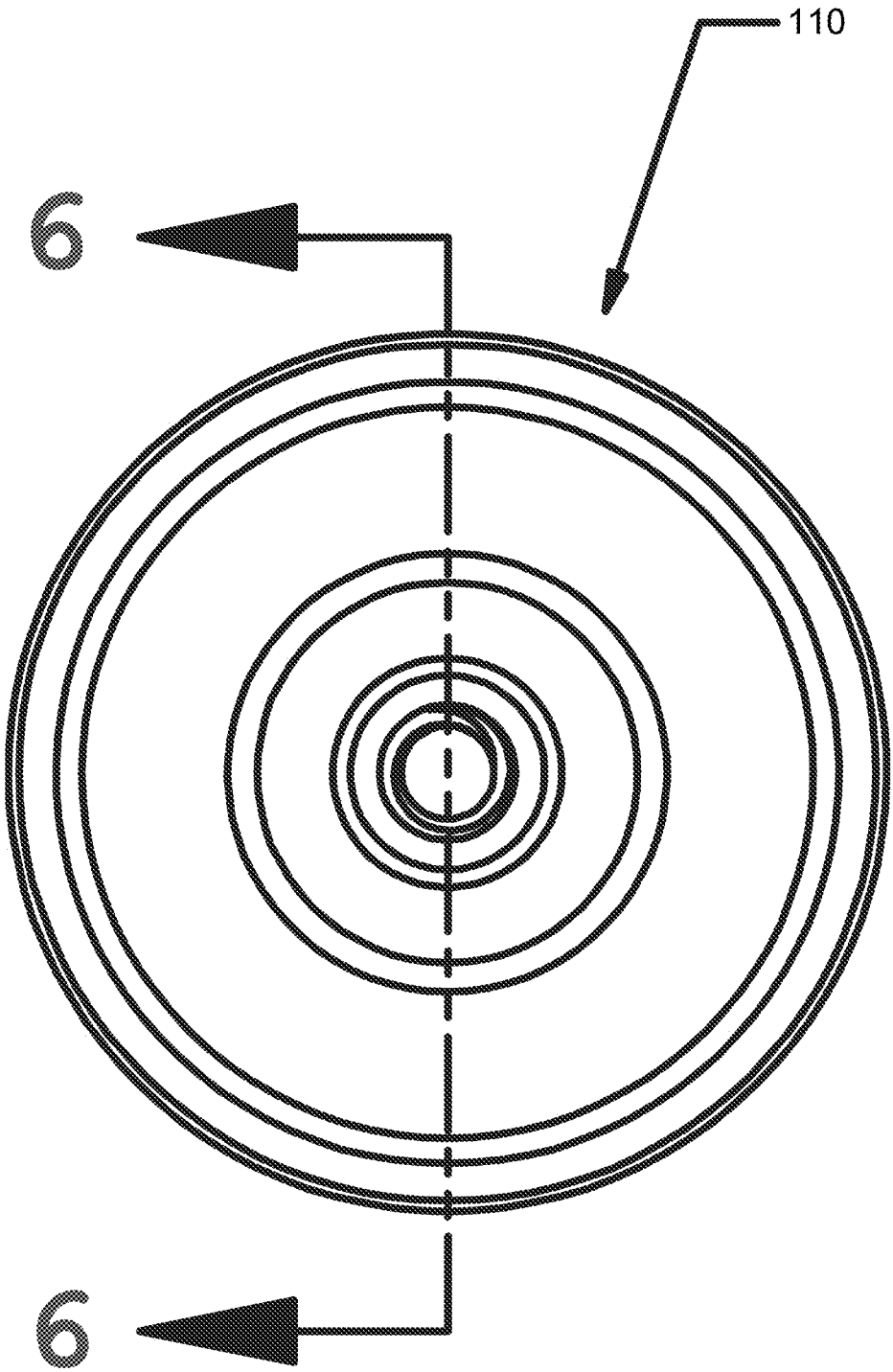
FIG. 5 is a top view of the mounting cleat portion appearing in FIG. 3.
Figure 5A:
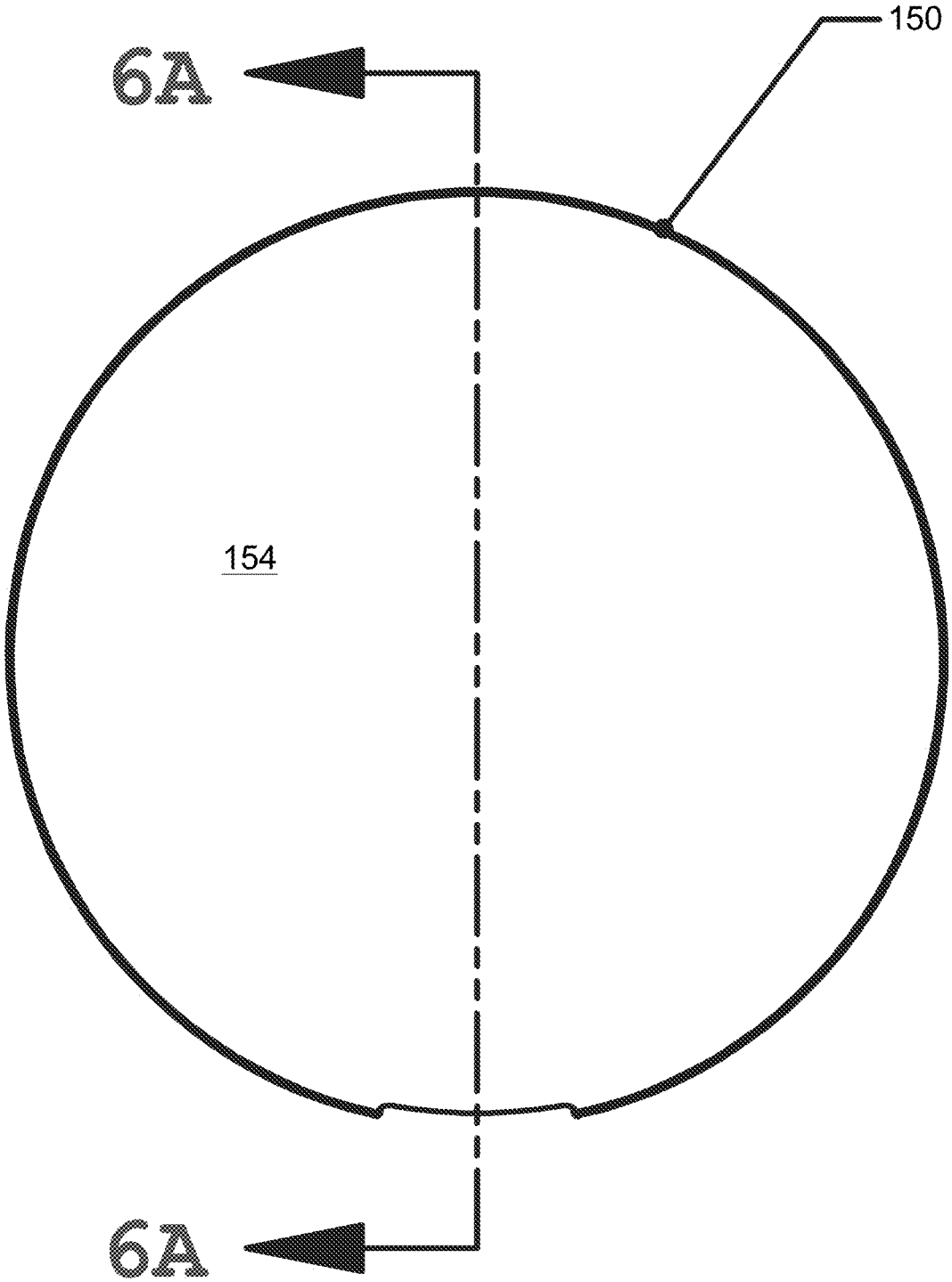
FIG. 5A is a top view of the cover portion of the embodiment appearing in FIG. 1.
Figure 6:
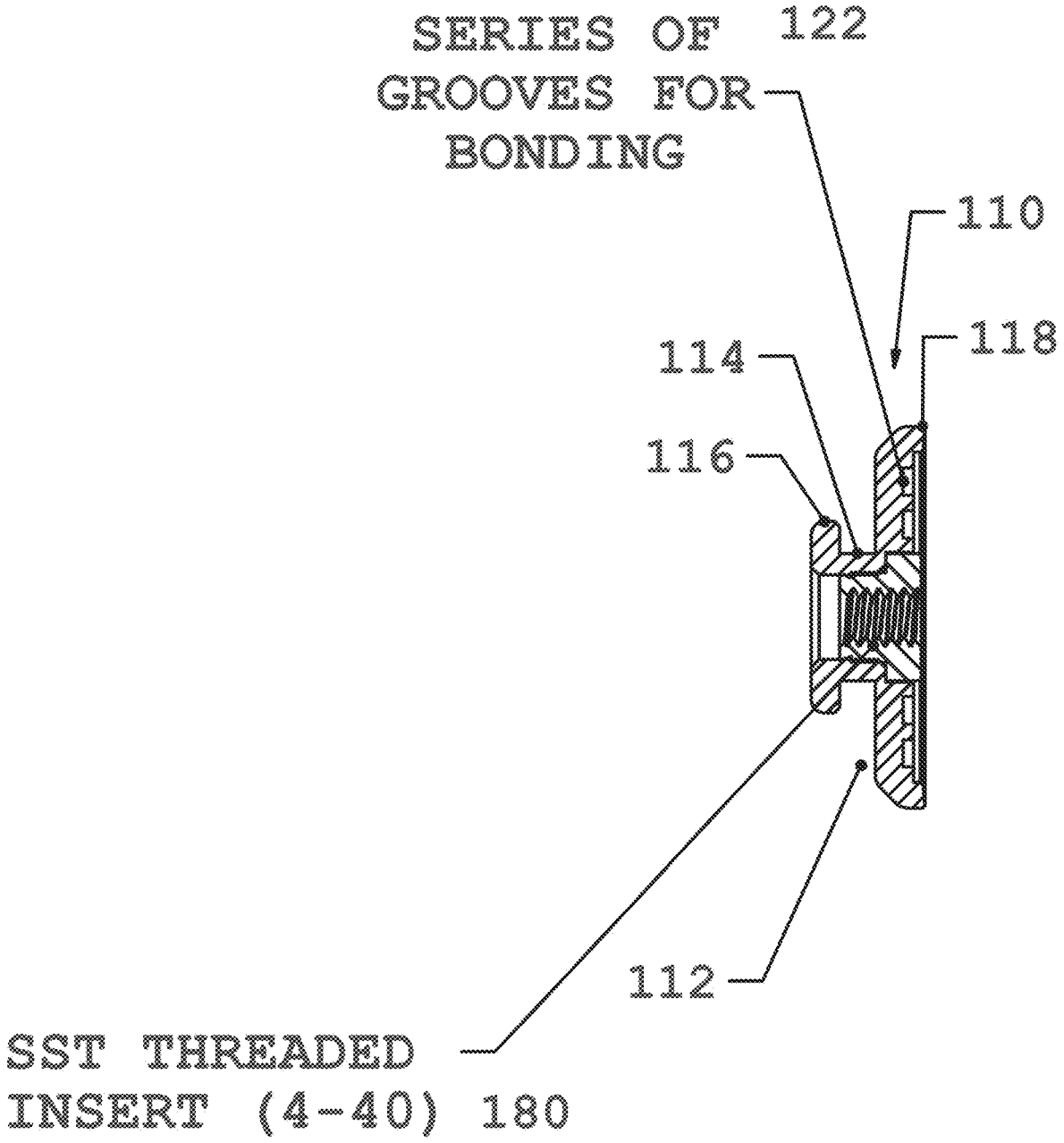
FIG. 6 is a side cross-sectional view taken along the lines of 6-6 of the mounting cleat portion appearing in FIG. 5.
Figure 6A:
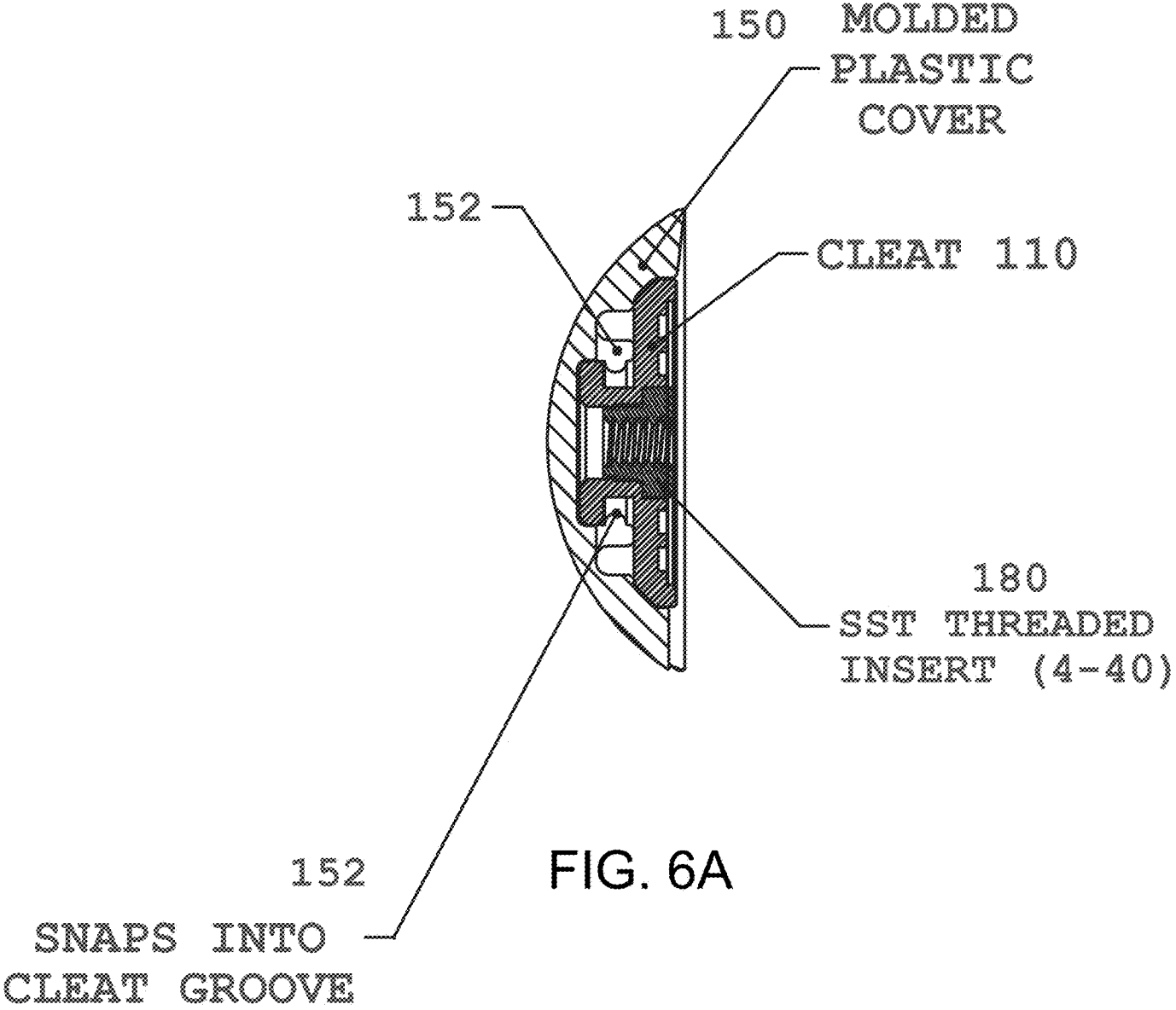
FIG. 6A is a side cross-sectional view taken along the lines 6A-6A of the cover portion appearing in FIG. 5A coupled with the mounting cleat portion.
Figure 6B:
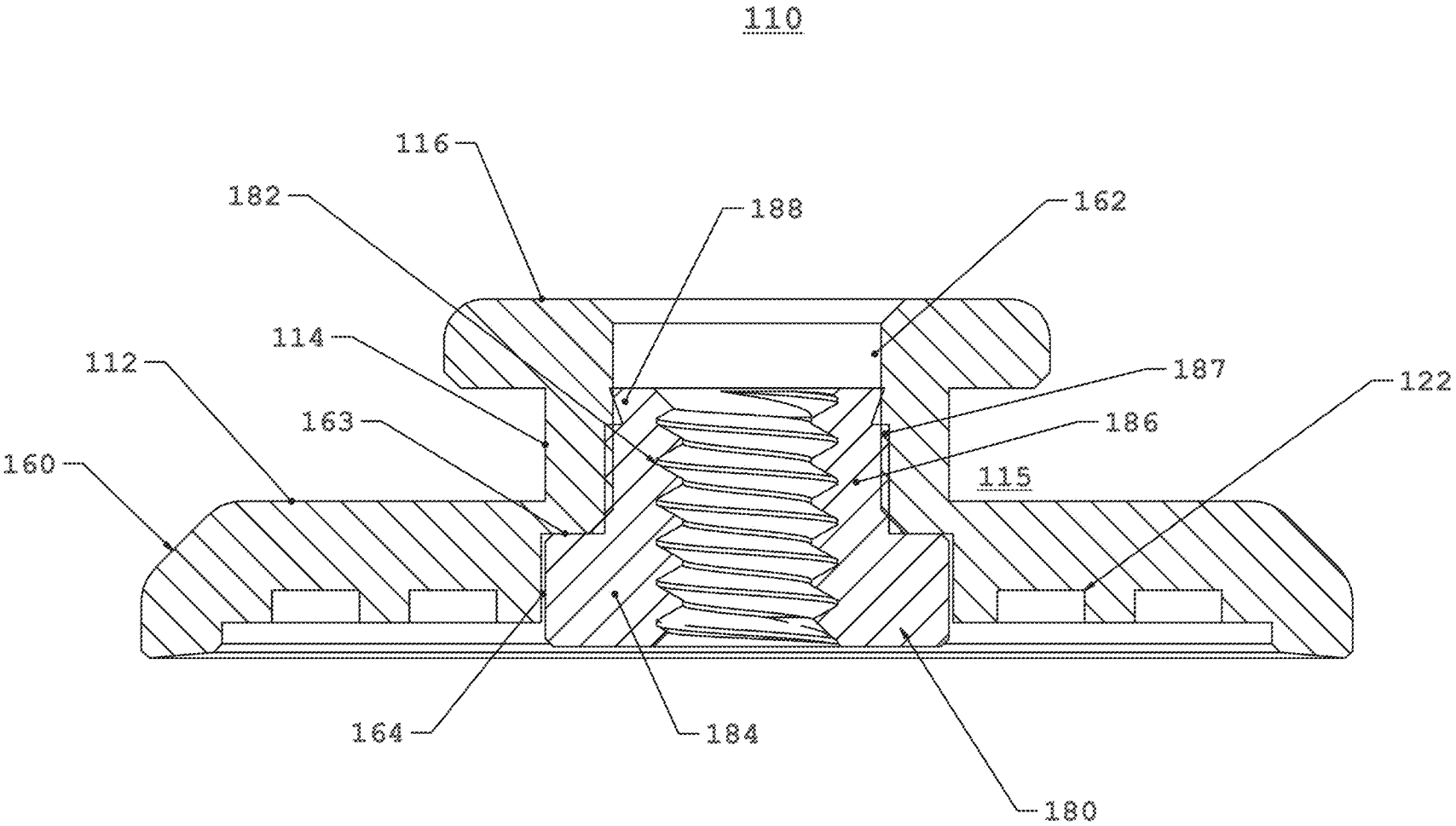
FIG. 6B is a side cross-sectional view taken along the lines of 6-6 of the mounting cleat portion appearing in FIG. 5.

FIGS. 3 and 4 are enlarged bottom and side views, respectively, of the cleat 110. FIG. 5 is a top view of the cleat 110 and FIG. 5A is a top view of the cleat 110 with the cover 150 attached. FIG. 6 is a side cross sectional view taken along the lines 6-6 appearing in FIG. 5 and FIG. 6A is a side cross sectional view taken along the lines 6A-6A appearing in FIG. 5A. FIG. 6B is an enlarged side cross-sectional view of the cleat 110. Although the exemplary cleats 110 are illustrated herein as having a generally circular peripheral shape, it will be recognized that the peripheral shape may be any desired shape, including three-sided, four-sided (e.g., square), five-sided, six-sided (e.g., regular hexagonal), or any other geometric shape.

The cleat 110 includes an outer portion 160 and a threaded insert 180 received within a cavity defined by the outer portion 160. In certain embodiments, the outer portion 160 is formed of a first metal, polymer material, or a fiber reinforced polymer composite material. In certain embodiments, the first metal is aluminum, preferably hard coat anodized aluminum. In certain embodiments, the polymer materials are thermoset or thermoplastic polymer materials used in advanced polymer composite systems. Exemplary polymers include, but are not limited to, polyamides and polycarbonates. In certain embodiments, the fiber reinforced polymer composite material comprises a polymer matrix material selected from thermoset or thermoplastic polymer materials used in advanced polymer composite systems, including but not limited to polyamides and polycarbonates, and reinforcing fibers formed of high strength fibers used in advanced polymer composite systems, including but not limited to carbon fiber, graphite, carbon nanotubes, glass fibers, aramid fibers, and so forth.

In certain embodiments, the threaded insert 180 is formed of a second metal which is harder than the first metal. In certain embodiments, the threaded insert is formed of stainless steel. In certain embodiments, the outer portion 160 and threaded insert 180 are formed of materials which will allow the outer portion 160 to cold flow into a feature of the threaded insert 180 upon the application of a clamping or pressing force urging the threaded insert 180 into the outer portion 160 without substantially deforming the threaded insert 180.

In certain embodiments, the cleat 110 is plated or otherwise coated with a plating material which matches the color of the helmet. The cleat 110 includes a flange or base 112 having a post 114 extending therefrom in a direction away from the helmet when the cleat 110 is attached to the helmet in its operational position. The post 114 has an enlarged diameter head 116 at its distal end, opposite the base 112. The base 112, post 114 and head 116 cooperate to define channel 115, which defines a first fastening mechanism for attaching a device (not shown) to the associated helmet 100. The device may be, e.g., an accessory device, or, a mounting apparatus, bracket, shroud, etc., for an accessory device. The threaded insert 180 provides a second fastening mechanism for a device. Such devices may be configured to attach only to the first fastening mechanism, only to the second mechanism, or, to both the first and second mechanisms simultaneously.

As best seen in FIG. 6B, the cleat 110 includes an outer portion 160 and a threaded insert 180 received within a cavity defined by the outer portion 160.

In certain embodiments, the outer portion 160 is formed of a first metal, polymer material, or a fiber reinforced polymer composite material. In certain embodiments, the first metal is aluminum, preferably hard coat anodized aluminum. In certain embodiments, the polymer materials are thermoset or thermoplastic polymer materials used in advanced polymer composite systems. In certain embodiments, the fiber reinforced polymer composite material comprises a polymer matrix material selected from thermoset or thermoplastic polymer materials used in advanced polymer composite systems and reinforcing fibers formed of high strength fibers used in advanced polymer composite systems, including but not limited to carbon fiber, graphite, carbon nanotubes, glass fibers, aramid fibers, and so forth.

In certain embodiments, the threaded insert 180 is formed of a second metal which is harder than the first metal. In certain embodiments, the threaded insert is formed of stainless steel. In certain embodiments, the outer portion 160 and threaded insert 180 are formed of materials which will allow the outer portion 160 to cold flow into a feature of the threaded insert 180 upon the application of a clamping or pressing force urging the threaded insert 180 into the outer portion 160 without substantially deforming the threaded insert 180.

The threaded insert 180 includes a tapped threaded opening 182 extending in an axial direction therethrough, the threaded opening 182 configured to receive a complimentary threaded fastener for securing an accessory device or a mounting bracket, shroud, or other apparatus for securing an accessory device to the helmet.

In the illustrated embodiment, the outer portion 160 includes a central bore 162 extending therethrough and a counterbore 164 extending through the flange 112 and into the base 114, the counterbore defining a shoulder 163. The threaded insert 180 includes an enlarged diameter base 184 which is received in the counterbore 164 and which abuts the shoulder 163. In the illustrated embodiment, the enlarged diameter base 184 resists axial pulling forces on the threaded insert.

In the illustrated embodiment, the threaded insert 180 includes a body 186 which is sized to be received in the bore 182 of the outer portion 180. In certain embodiments, the body 186 includes features 187 such as splines, flutes, serrations, or the like, for resisting torque on the threaded insert 180 when threaded fasteners are secured to or removed from the threaded opening 182. In certain embodiments, the body 186 further includes a back tapered shank 188 for resisting axial pushing forces on the threaded insert. In certain embodiments, the threaded inserts may be PEM® fasteners available from Penn Engineering & Manufacturing Corp. of Danboro, Pa., or other similar self-clinching fasteners available from other manufacturers.

It will be recognized that other configurations are possible and other methods of securing the threaded insert 180 within the outer portion 160 are contemplated. In certain embodiments, the threaded insert is secured within the outer portion with an adhesive. In certain embodiments, the outer portion 160 is co molded or overmolded over the threaded insert.

Figure 6C:
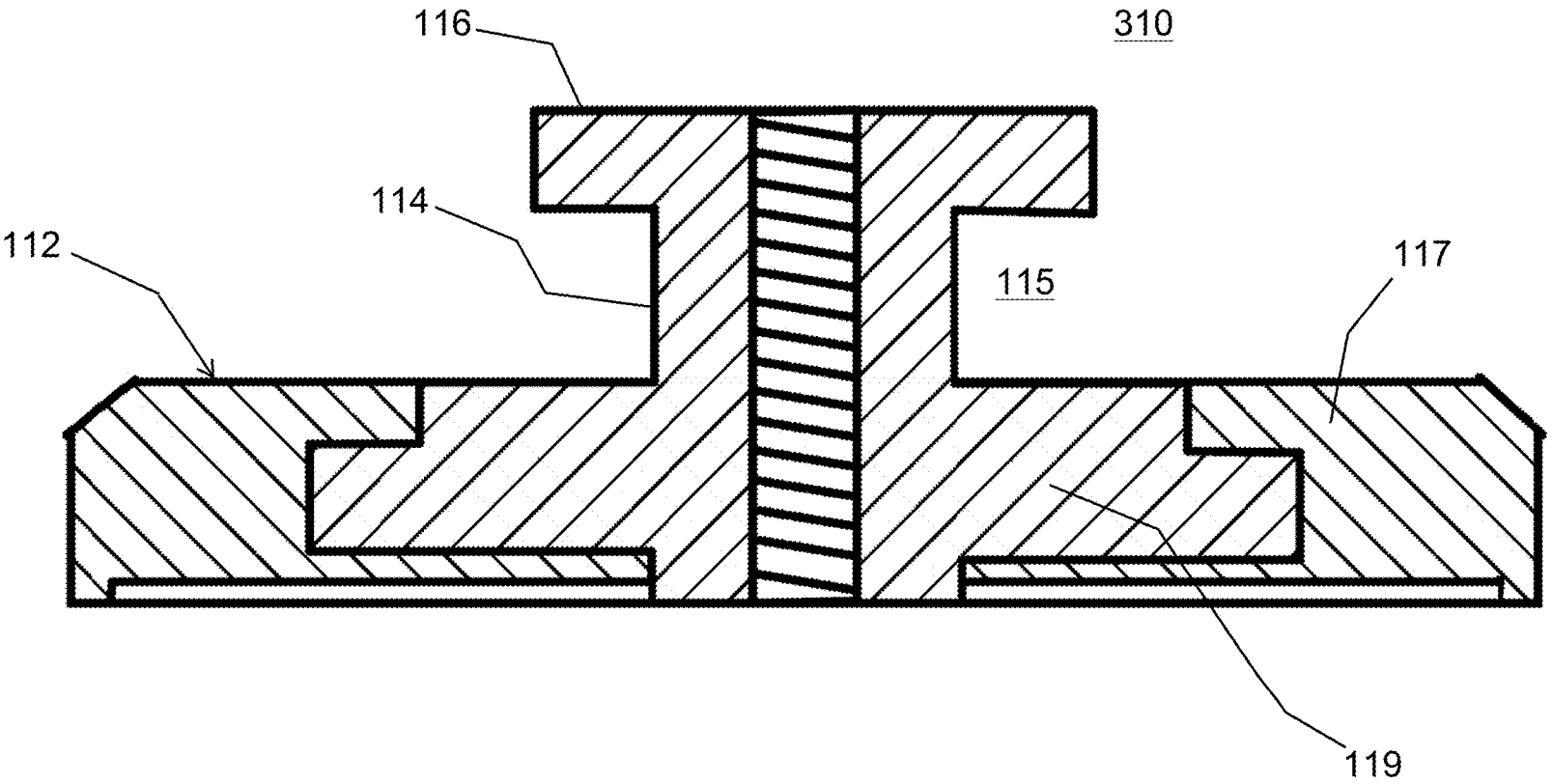
FIG. 6C is a side cross-sectional view of a mounting cleat portion according to a second exemplary embodiment.

In yet another embodiment as illustrated in FIG. 6C, a cleat 310 having a similar cross-sectional profile as the cleat 110 including a head 116, a post 114, and a base 112 cooperating to define a channel 115, is shown. The cleat 310 is formed a generally H-shaped metal spool 119, e.g., formed via machining, having tapped internal threads. A polymer or polymer composite material 117 is combined with the partial base to provide an overmolded base portion which conforms to the helmet.

The base member 112 further includes a raised annular wall or lip 118 at the outer peripheral edge of the base 112. The annular wall or lip 118 extends generally in a direction toward the helmet when the cleat 110 is attached to the helmet in its operational position. The base 112 and the lip 118 cooperate to define a cavity 120 which is filled with the adhesive 130 used to secure the cleat 110 to the helmet 100.

In certain embodiments, the helmet-facing surface of the base 112 includes one or more annular grooves 122 for improving the bond between the cleat 110 and the helmet 100. It will be recognized that other geometric patterns besides concentric grooves may be employed to providing increased bonding surface area. In certain embodiments, the adhesive is selected from the group consisting of single-component, heat curable epoxy adhesives, two-component epoxy adhesives, structural acrylic adhesives, including acrylic and methyl methacrylate adhesives, and cyanoacrylate adhesives.

Figure 7:
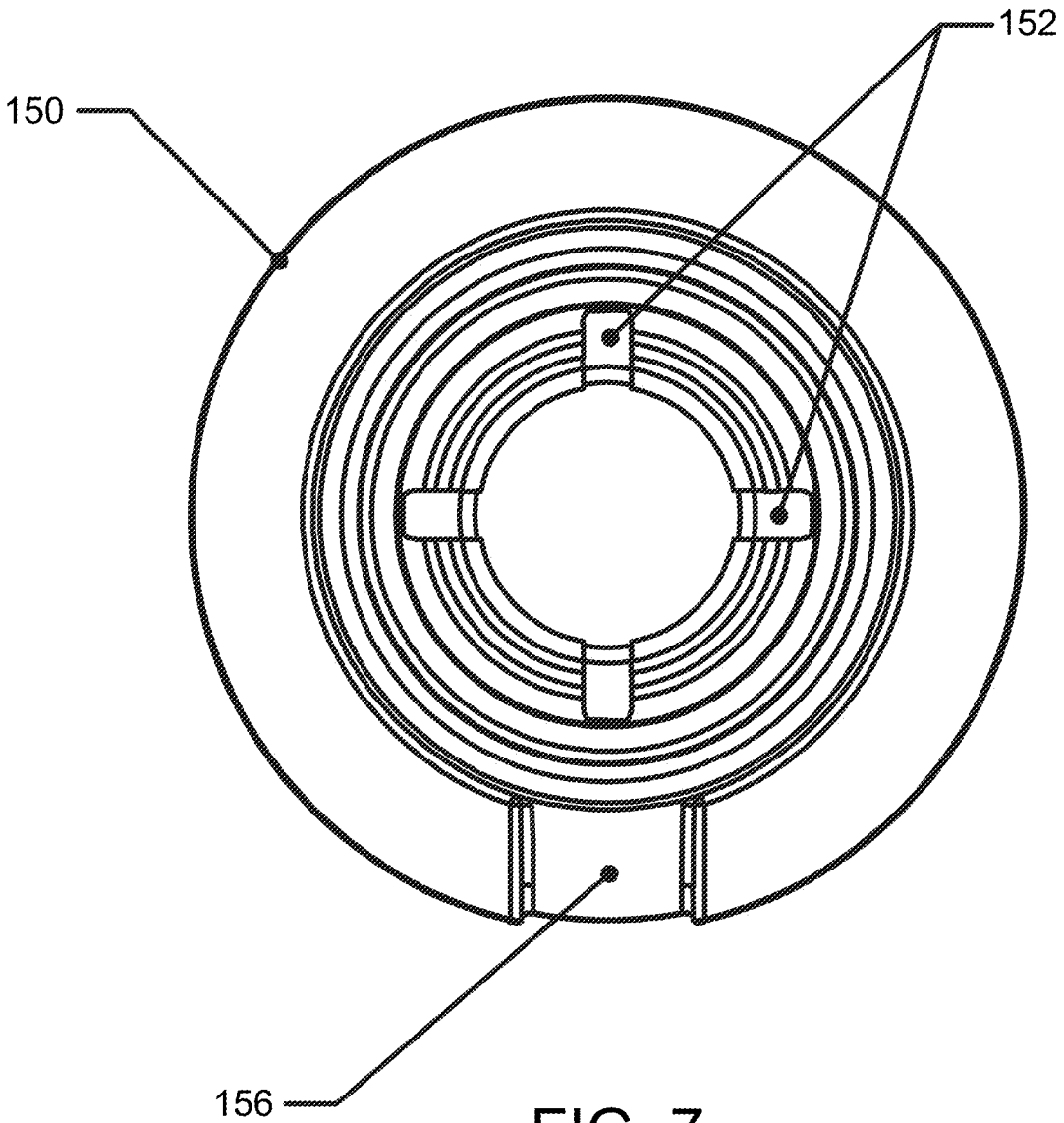
FIG. 7 is a bottom view of the cover portion of the helmet mount system appearing in FIG. 1.
Figure 8:
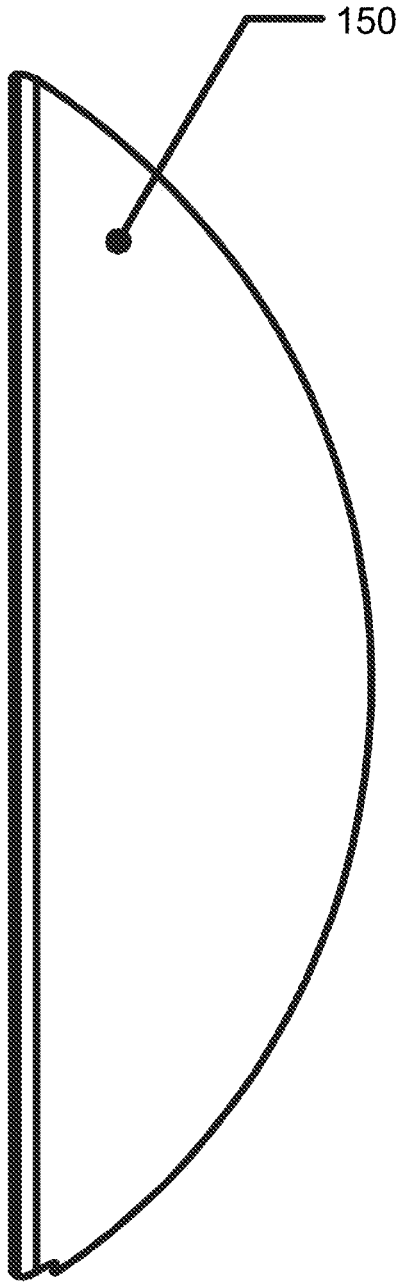
FIG. 8 is a side view of the cover portion appearing in FIG. 7.
Figure 9:
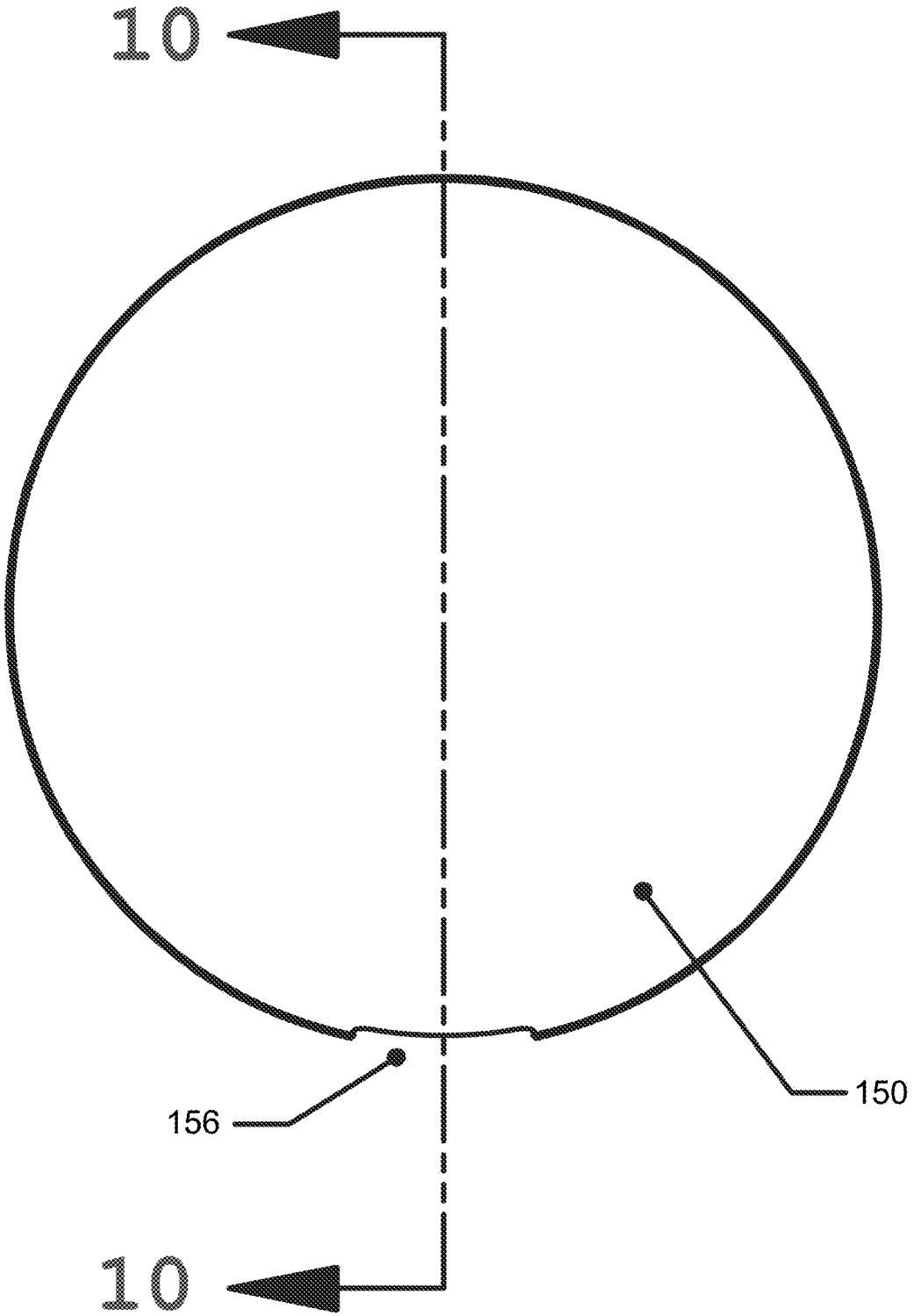
FIG. 9 is a top view of the cover portion of the cover appearing in FIG. 7.
Figure 10:
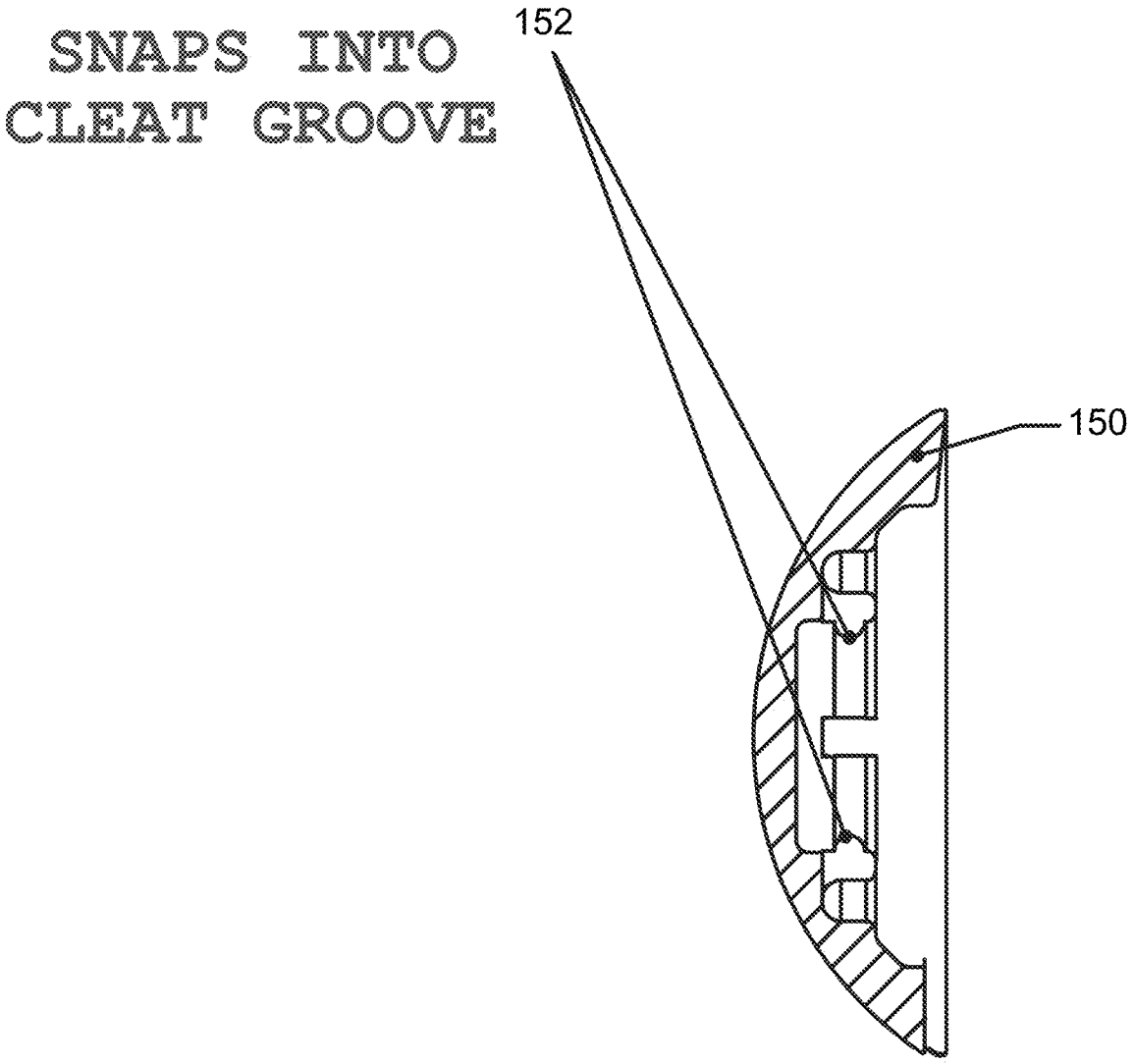
FIG. 10 is a side cross-sectional view taken along the lines 10-10 of the cover portion appearing in FIG. 9.

In certain embodiments, a cover 150 is removably attachable to the cleat 110 when the cleat 110 is not in use for attaching a helmet mounted-accessory device or mounting hardware. FIG. 7 is a bottom view of an exemplary cover 150. FIGS. 8 and 9 are side and top views, respectively, thereof. FIG. 10 is a side cross-sectional view taken along the lines 10-10 appearing in FIG. 9.

The cover 150 defines a receptacle complementary in profile to the cleat 110 and includes resilient fastener elements 152 for removable attachment to the cleat 110 e.g., via a snap fit engagement with the annular channel defined by the base 112, post 114, and head 116. The outer surface 154 of the cover 150 is preferably smooth and rounded to prevent snags when the helmet is worn in areas with brush or other snag hazards. The cover 150 also prevents damage to or fouling of the cleats and threaded opening then the threaded cleats are not in use. In certain embodiments, a notch 156 is provided in the cover to facilitate removal of the cover with a tool, such as a screwdriver or other flat-edged pry tool, or the like.

In certain embodiments, the dimensions of the cleat 110, such as the height, diameter, and thickness of the base 112, post 214, head 216, etc., may be standardized to define a common interface standard that multiple manufacturers can design to.

Figure 11:
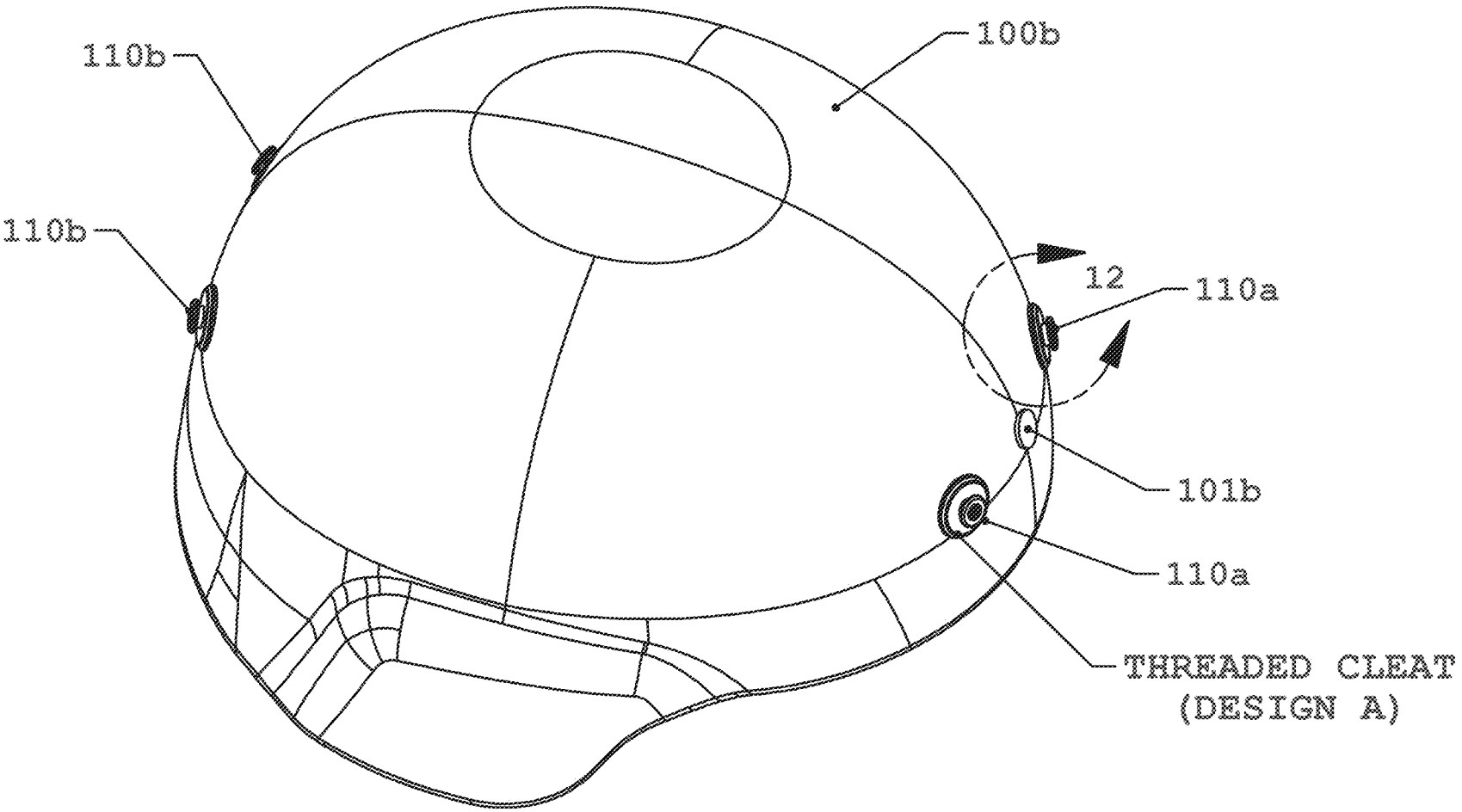
FIG. 11 is an isometric view of a helmet mount system according to a third exemplary embodiment.
Figure 12:
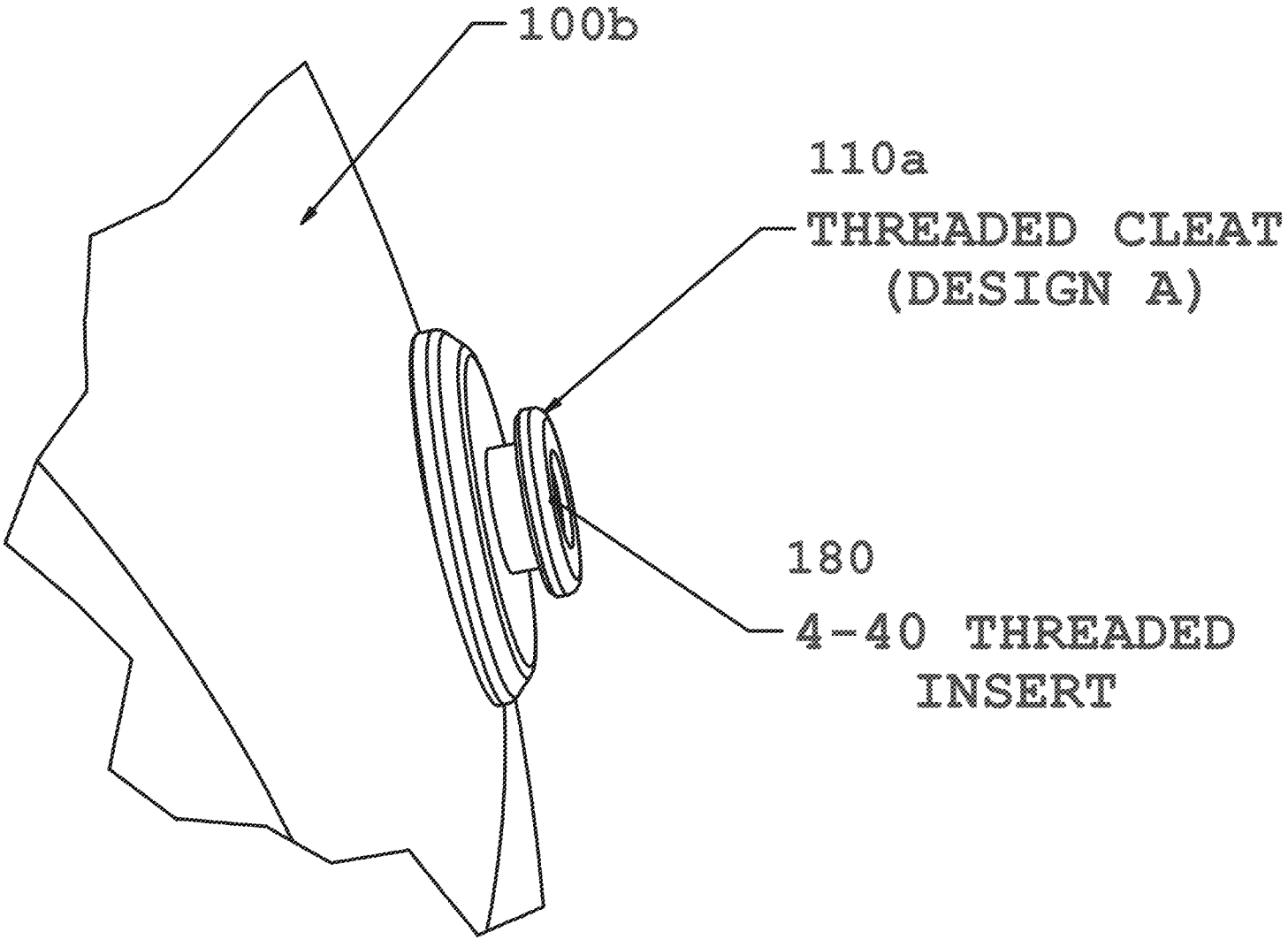
FIG. 12 is a fragmentary view of the embodiment appearing in FIG. 11.

FIG. 11 shows a second helmet configuration wherein a helmet 100*b* includes four cleats 110 adhesively attached to the helmet 100*b*. FIG. 12 is an enlarged view of the region 8 appearing in FIG. 11. In the configuration appearing in FIG. 11, there are two cleats 110*a* disposed on the front portion of the helmet 100*b* and two cleats 110*b* disposed on the rear portion of the helmet 100*b*. The two cleats 110*a* are spaced apart and are on opposite sides of the median plane of the helmet 100. Likewise, the two cleats 110*b* are spaced apart and are on opposite sides of the median plane of the helmet 100*b*. In certain embodiments, the configuration appearing in FIG. 11 is adapted for attaching a forward shroud (e.g., for attaching a mounting system for a night vision device) and a rear battery compartment dock.

Although an advantage of the present invention is that it avoids the need to drill holes in the helmet shell, it will be recognized that the present invention may also be employed with existing helmets which may have one or more pre-drilled holes. In such instances, such pre-drilled holes should have a ballistic grade screw 101*b* screwed into the existing screw hole.

In certain embodiments, the cleat dimensions, e.g., as described above, and the cleat spacing may be standardized to define a common interface standard that multiple manufactures can design to.

Figure 13:
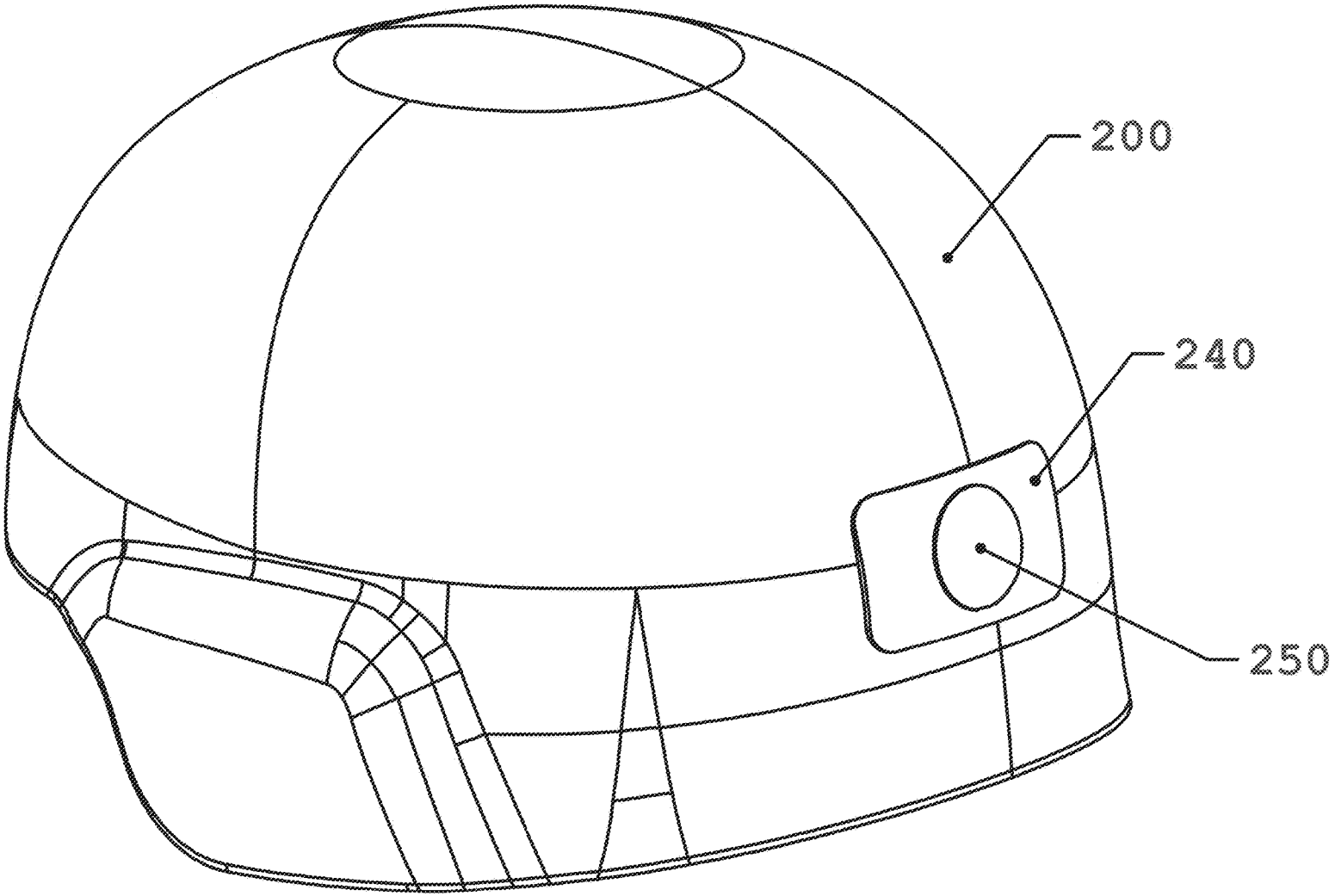
FIG. 13 is an isometric view of a helmet mount system according to a fourth exemplary embodiment.

Referring now to FIG. 13, an isometric view of an exemplary helmet 200 (e.g., which may be as described above) appears, having one mounting cleat 210 in accordance with this disclosure attached to the rear and central portion of the helmet. It will be recognized that the illustrated embodiment is exemplary only and that the embodiment of FIG. 1 can be adapted for positioning at any one or more locations on the helmet 200, including, for example, the front, side(s), top, and elsewhere.

Figure 14:
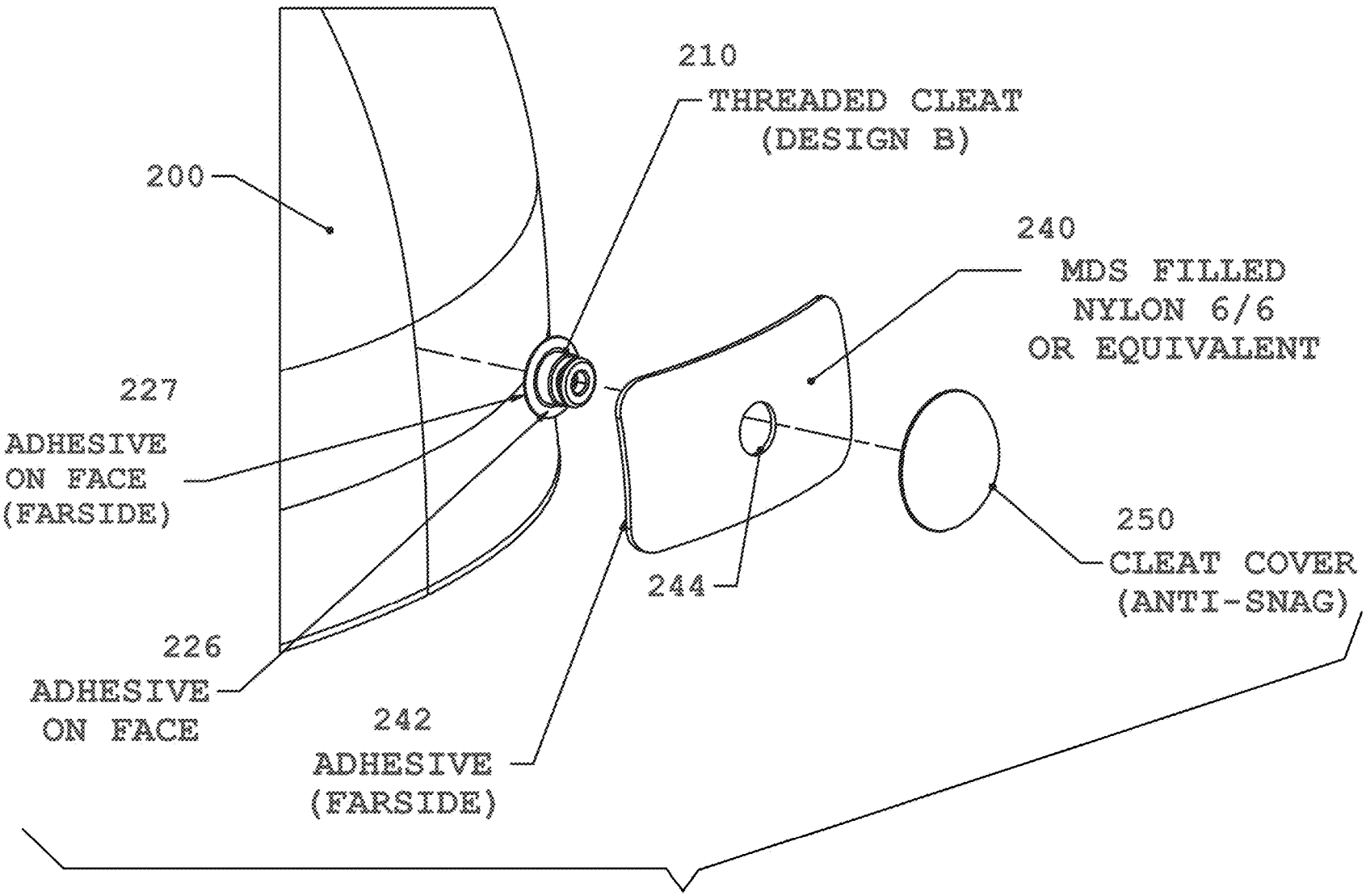
FIG. 14 is a fragmentary exploded view of the embodiment appearing in FIG. 13.

FIG. 14 is a fragmentary, exploded view of the helmet and cleat system appearing in FIG. 13. The cleat system includes a cleat 210, which is secured to the helmet surface with an adhesive-backed securing member 240, and may further include a cover 250.

Figure 15:
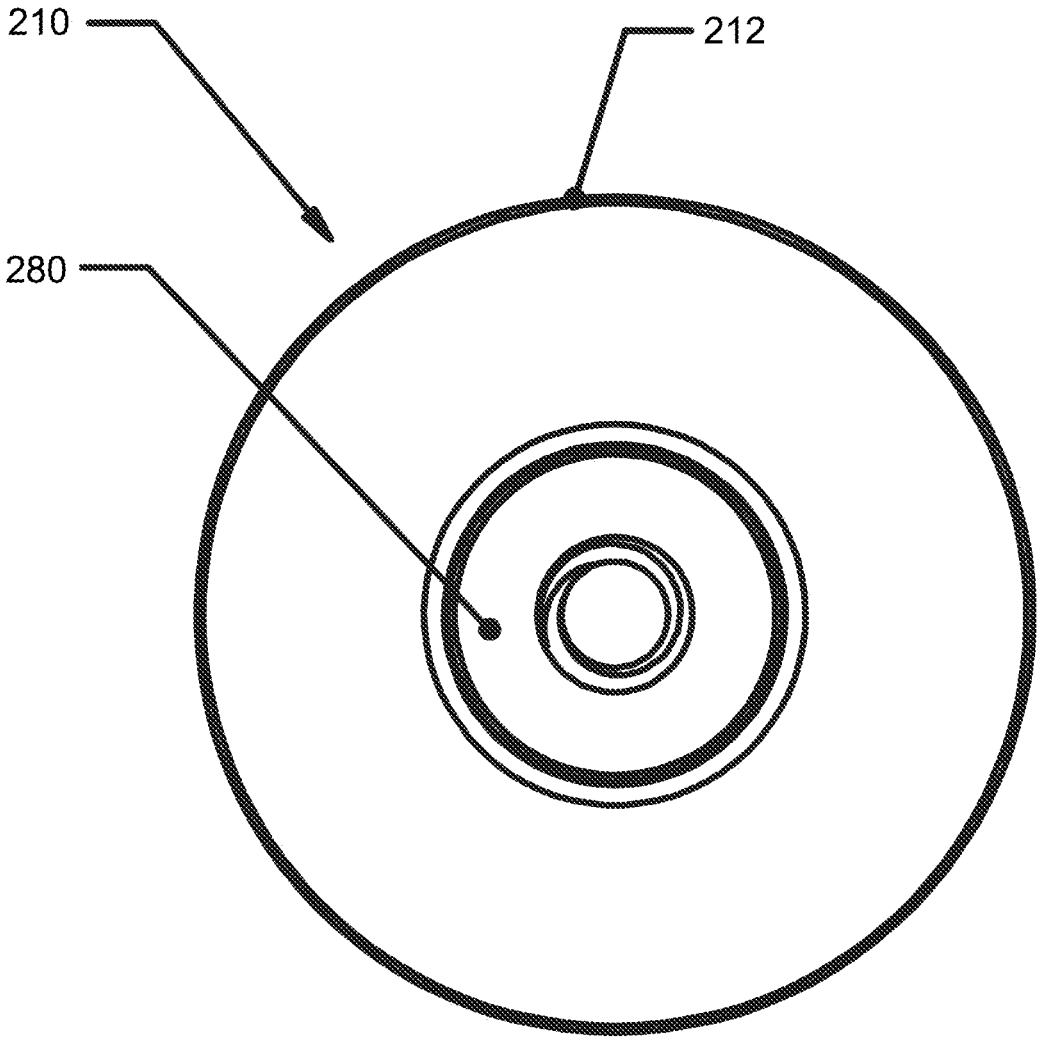
FIG. 15 is a bottom view of the mounting cleat portion of the embodiment appearing in FIG. 13.
Figure 16:
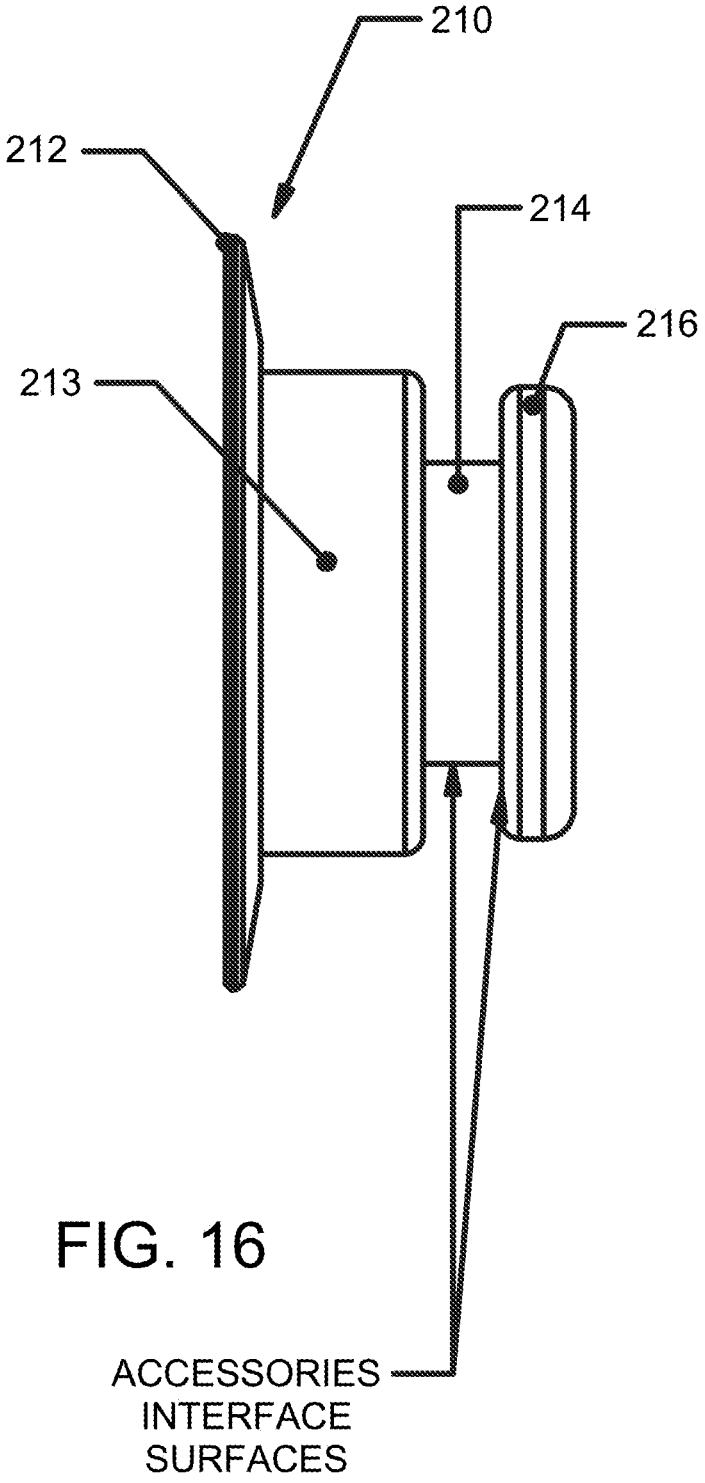
FIG. 16 is a side view of the mounting cleat portion of the embodiment appearing in FIG. 13.
Figure 17:
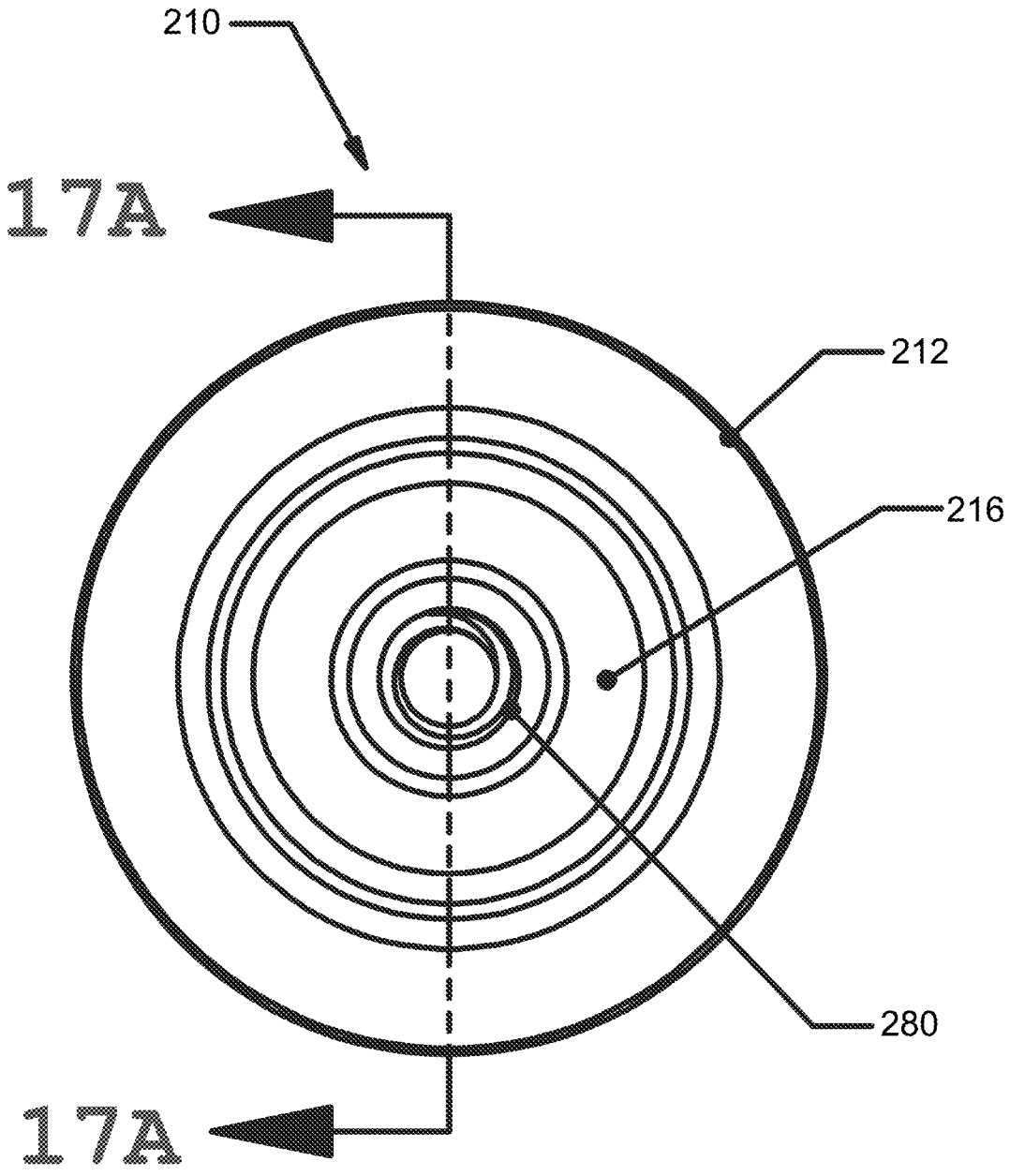
FIG. 17 is a top view of the mounting cleat portion of the embodiment appearing in FIG. 13.
Figure 17A:
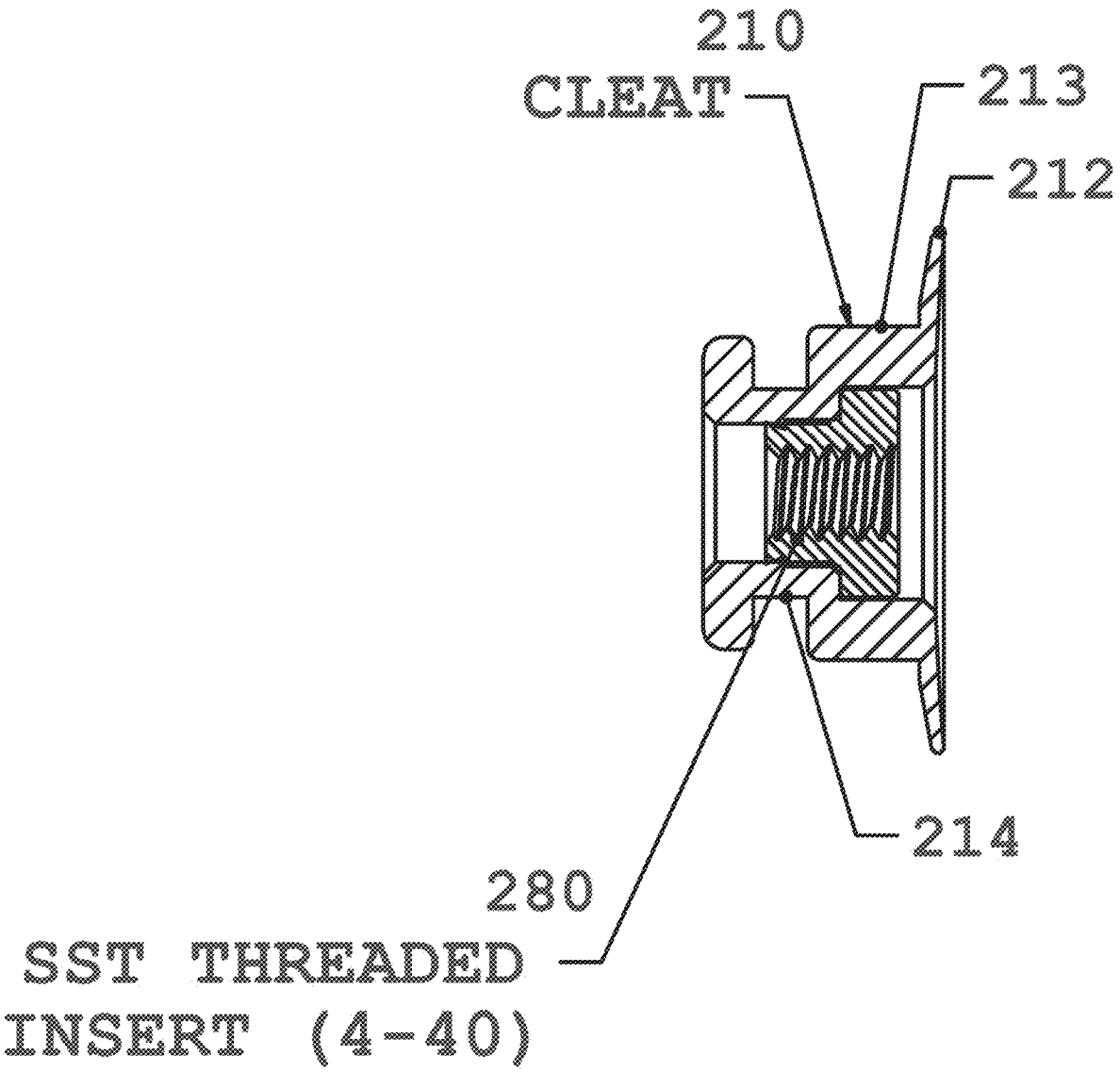
FIG. 17A is a side cross-sectional view taken along the lines of 17A-17A of the mounting cleat portion appearing in FIG. 17.
Figure 17B:
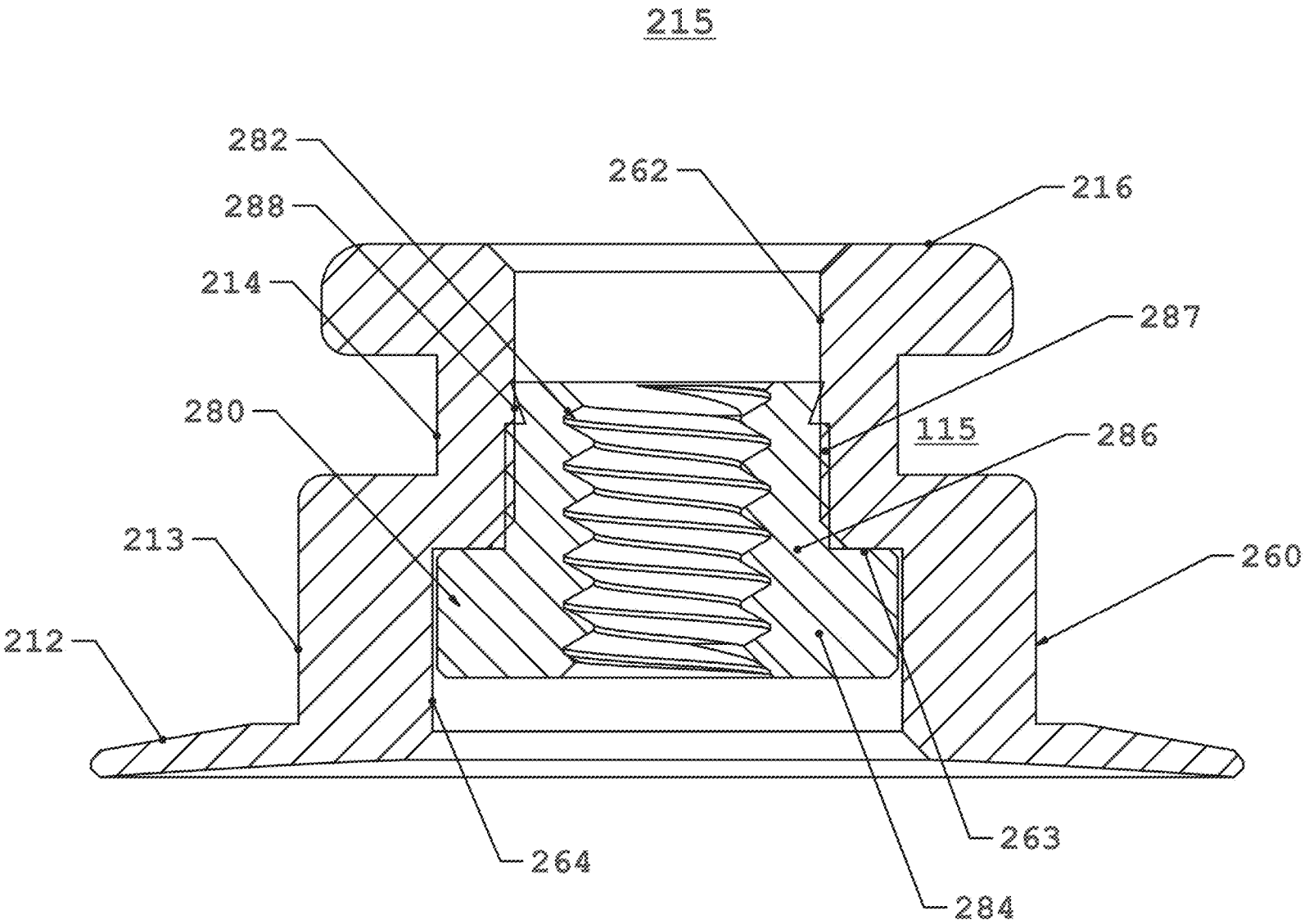
FIG. 17B is a side cross-sectional view taken along the lines of 17A-17A of the mounting cleat portion appearing in FIG. 17.

FIGS. 15 and 16 are enlarged bottom and side views, respectively, of the cleat 210. FIG. 17 is a top view of the cleat 210. FIG. 17A is a side cross-sectional view taken along the lines 17A-17A appearing in FIG. 17. FIG. 17B is an enlarged side cross-sectional view of the cleat 210.

In certain embodiments, the cleat 210 is formed of a metal, preferably aluminum. In certain embodiments, the cleat 210 is formed of molded polymer with a stainless steel threaded insert. The cleat 210 includes a flange 212 having a base 213 extending therefrom in a direction away from the helmet when the cleat 210 is attached to the helmet in its operational position. A post 214, in turn, extends from the base in a direction away from the helmet when the cleat 210 is attached to the helmet in its operational position. The post 214 has an enlarged diameter head 216 at its distal end, opposite the base 213. The post 214 has an enlarged diameter head 216 at its distal end, opposite the base 213. The base 213, post 214 and head 216 cooperate to define a channel 215, which defines a first fastening mechanism for attaching a device (not shown) to the associated helmet 200. The device may be, e.g., an accessory device, or, a mounting apparatus, bracket, shroud, etc., for an accessory device. The threaded insert 280 provides a second fastening mechanism for a device. Such devices may be configured to attach only to the first fastening mechanism, only to the second mechanism, or, to both the first and second mechanisms simultaneously.

As best seen in FIG. 17B, the cleat 210 includes an outer portion 260 and a threaded insert 280 received within a cavity defined by the outer portion 260.

The threaded insert 280 includes a tapped threaded opening 282 extending in an axial direction therethrough, the threaded opening 282 configured to receive a complimentary threaded fastener for securing an accessory device or a mounting bracket, shroud, or other apparatus for securing an accessory device to the helmet.

In the illustrated embodiment, the outer portion 260 includes a central bore 262 extending therethrough and a counterbore 264 extending through the flange 112 and into the base 114, the counterbore defining a shoulder 263. The threaded insert 280 includes an enlarged diameter base 284 which is received in the counterbore 264 and which abuts the shoulder 263. In the illustrated embodiment, the enlarged diameter base 284 resists axial pulling forces on the threaded insert.

In the illustrated embodiment, the threaded insert 280 includes a body 286 which is sized to be received in the bore 262 of the outer portion 260. In certain embodiments, the body 286 includes features 287 such as splines, flutes, serrations, or the like, for resisting torque on the threaded insert 280 when threaded fasteners are secured to or removed from the threaded opening 282. In certain embodiments, the body 286 further includes a back tapered shank 288 for resisting axial pushing forces on the threaded insert. In certain embodiments, the threaded inserts may be PEM® fasteners available from Penn Engineering & Manufacturing Corp. of Danboro, Pa., or other similar self-clinching fasteners available from other manufacturers.

It will be recognized that other configurations are possible and other methods of securing the threaded insert 280 within the outer portion 260 are contemplated. In certain embodiments, the threaded insert is secured within the outer portion with an adhesive. In certain embodiments, the outer portion 260 is co molded or overmolded over the threaded insert. In certain embodiments, an overmolded or comolded cleat construction may be provided as described above by way of reference to FIG. 6C.

The illustrated embodiment depicts a single cleat 210 secured with the adhesive-backed securing member 240 at a single, exemplary position on the helmet 200. It will be recognized, however, that any number of cleats 210 may be secured in the same manner at any desired position(s) on the helmet 200.

The adhesive-backed securing member 240 is formed of a sheet material, which may be a molded or extruded polymer material. In certain embodiments, the material is a nylon material, and in preferred embodiments, is formed of a molybdenum disulfide (MDS) filled nylon 6/6 material. The adhesive-backed securing member 240 has an adhesive layer 242 disposed on the helmet facing surface thereof. An aperture 244 is formed in the adhesive-backed securing member 240. The cleat 210 extends through the aperture 244 and the adhesive-backed securing member 240 is adhesively bonded to the surface of the helmet. The adhesive-backed securing member 240 engages the flange 212 to secure the cleat 210 to the helmet 200. In certain embodiments, no adhesive is used between the helmet and the helmet facing surface of the cleat 210. In certain embodiments, an adhesive layer is used between the helmet and the helmet facing surface of the cleat 210. Optionally, an adhesive layer may be provided on the outward facing surface 226 of the flange 212 to enhance the adhesive bond between the flange 212 and the adhesive layer 242.

The illustrated embodiment depicts an adhesive-backed securing member 240 having a single cleat-receiving aperture 244. It will be recognized, however, that each adhesive-backed securing member 240 could alternatively have multiple (e.g., 2, 3, 4, 5, or more) apertures 244 for securing a corresponding number cleats 210 to the helmet 200. In such multiple-cleat embodiments, the spacing between the multiple apertures can be selected to provide groupings of cleats spaced in accordance with some predetermined or prespecified spacing.

In certain embodiments, a cover 250 is provided which is removably attachable to the cleat 210 when the cleat 210 is not in use for attaching a helmet mounted-accessory device or mounting hardware. The cover 250 defines a receptacle that complementary with the shape of the cleat 210 and may include resilient members (not shown) removably engaging the cleat as described above by way of reference to the cover 150. The outer surface 254 of the cover 250 is preferably smooth and rounded to prevent snags when the helmet is worn in areas with brush or other snag hazards.

In certain embodiments, the dimensions of the cleat 210, such as the height, diameter, and thickness of the base 213, post 214, head 216, etc., may be standardized to define a common interface standard that multiple manufactures can design to.

Figure 18:
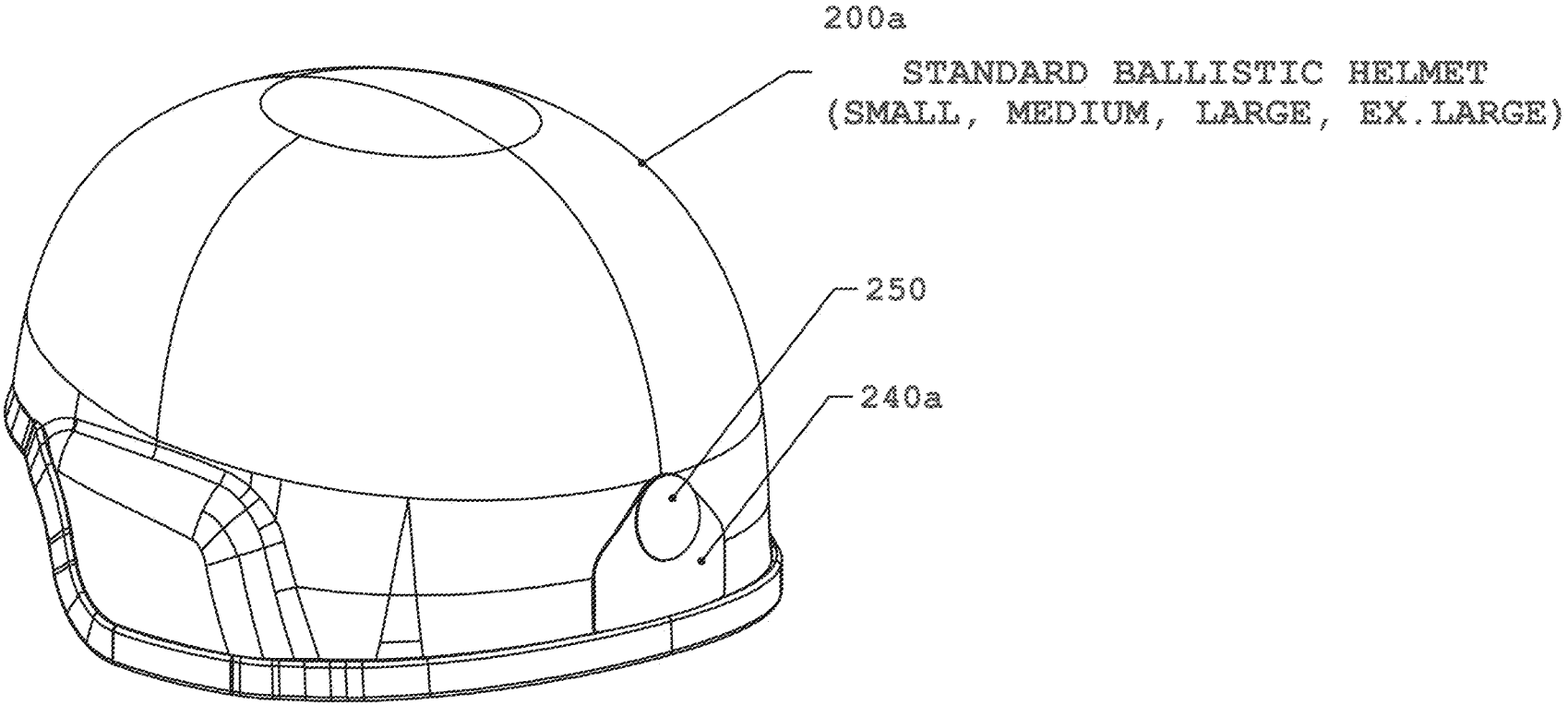
FIG. 18 is a helmet mount system according to a fifth exemplary embodiment.

Referring now to FIG. 18, an isometric view of an exemplary helmet 200*a* (e.g., which may be as described above) appears, having one mounting cleat 210 in accordance with this disclosure attached to the rear and central portion of the helmet. It will be recognized that the illustrated embodiment is exemplary only and that the embodiment of FIG. 1 can be adapted for positioning at any one or more locations on the helmet 200*a*, including, for example, the front, side(s), top, and elsewhere.

Figure 19:
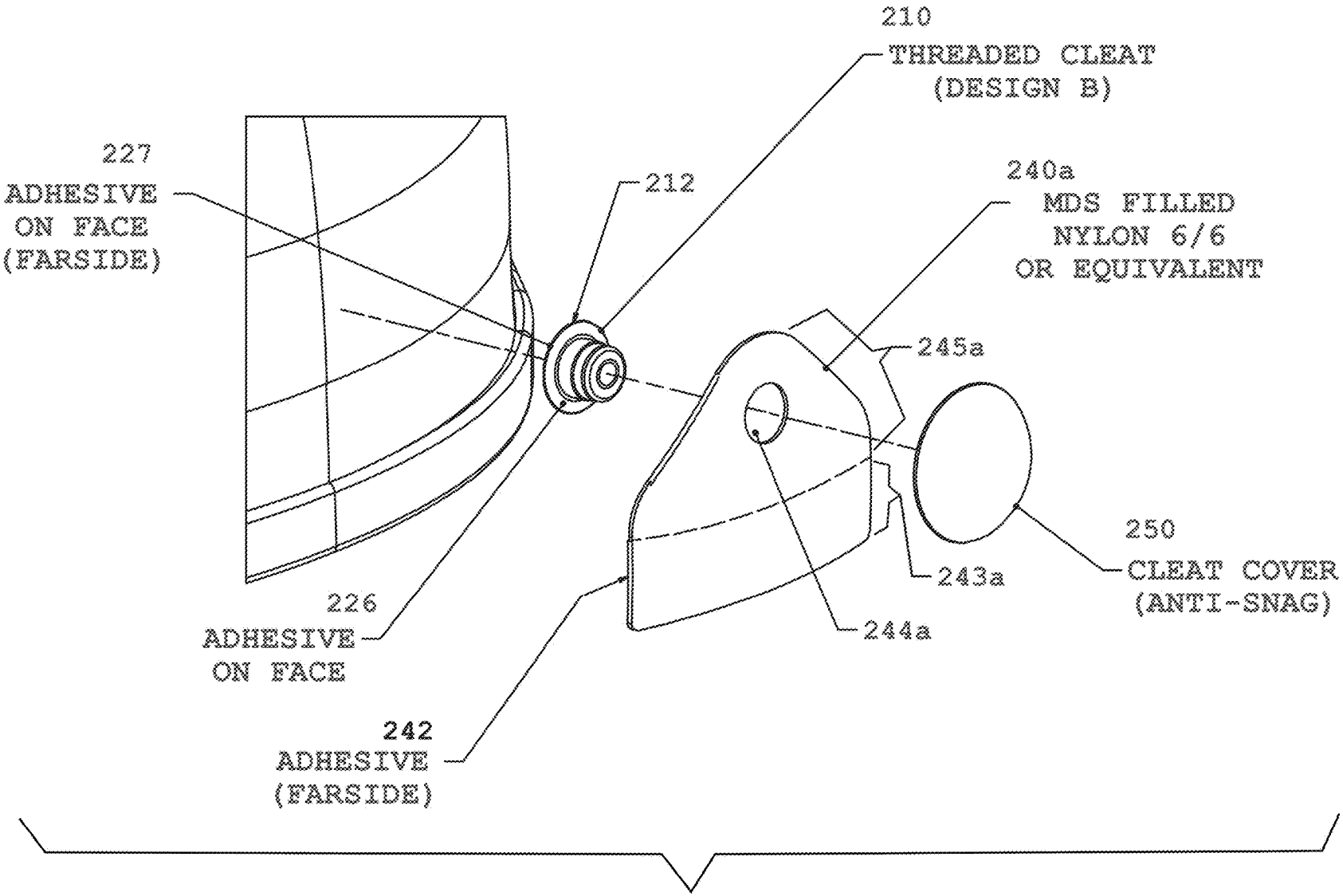
FIG. 19 is a fragmentary exploded view of the embodiment appearing in FIG. 18.

FIG. 19 is a fragmentary, exploded view of the helmet and cleat system appearing in FIG. 18. The cleat system includes a cleat 210, which is secured to the helmet surface with an adhesive-backed securing member 240*a*, and may further include a cover 250.

The cleat 210 and cover 250 appearing in FIGS. 18 and 19 are as described above by way of reference to FIGS. 13-17.

The adhesive-backed securing member 240*a* is formed of a sheet material, which may be a molded or extruded polymer material. In certain embodiments, the material is a nylon material, and in preferred embodiments, is formed of MDS filled nylon 6/6. The adhesive-backed securing member 240*a* has an adhesive layer 242*a* disposed on the helmet facing surface thereof.

In certain embodiments, the adhesive layer 242*a* is applied to a lower portion 243*a* of the adhesive-backed securing member and an upper portion 245*a* of the adhesive-backed securing member which carries the cleat 210 is adhesive-free. In such embodiments, upwards pressure from a cinched strap (not shown) attached to the cleat 210 (for example, a strap extending between the cleat 210 and a night vision mounting system (not shown) attached to the front of the helmet) would tend to flatten the upper portion 245*a* and the cleat 210 against the helmet.

Alternatively, in certain embodiments, the adhesive layer 242*a* is applied to the entire helmet-facing surface of the adhesive-backed securing member 240*a*.

The illustrated embodiment depicts a single cleat 210 secured with the adhesive-backed securing member 240*a* at a single, exemplary position on the helmet 200*a*. It will be recognized, however, that any number of cleats 210 may be secured in the same manner at any desired position(s) on the helmet 200*a*.

An aperture 244*a* is formed in the adhesive-backed securing member 240*a*. The cleat 210 extends through the aperture 244*a* and the adhesive-backed securing member 240*a* secures the flange 212 to surface of the helmet 200*a*. In certain embodiments, no adhesive is used between the helmet and the helmet facing surface of the cleat 210. In certain embodiments, an adhesive layer is used between the helmet and the helmet facing surface of the cleat 210.

In embodiments wherein the adhesive layer 242*a* is confined to the lower portion 243*a*, an adhesive layer is provided on the outward facing surface 226 of the flange 212 to secure the cleat 210 to the adhesive-backed securing member 240*a*. In embodiments wherein the adhesive layer

242*a* is applied to the entire helmet-facing surface of the adhesive-backed securing member 240*a*, the use of an adhesive on the outward facing surface 226 of the flange 212 is optional.

The illustrated embodiment depicts an adhesive-backed securing member 240*a* having a single cleat-receiving aperture 244*a*. It will be recognized, however, that each adhesive-backed securing member 240*a* could alternatively have multiple (e.g., 2, 3, 4, 5, or more) apertures 244*a* for securing a corresponding number cleats 210 to the helmet 200*a*. In such multiple-cleat embodiments, the spacing between the multiple apertures can be selected to provide groupings of cleats spaced in accordance with some predetermined or pre-specified spacing.

In certain embodiments, a cover 250 is provided which is removably attachable to the cleat 210 when the cleat 210 is not in use for attaching a helmet mounted-accessory device or mounting hardware. The cover 250 defines a receptacle that complementary with the shape of the cleat 210 and may include resilient members (not shown) removably engaging the cleat as described above by way of reference to the cover 150. The outer surface 254 of the cover 250 is preferably smooth and rounded to prevent snags when the helmet is worn in areas with brush or other snag hazards.

In the illustrated embodiment, the adhesive-backed securing member 240*a* is a separately formed piece, and is separate from a helmet edge trim piece 206*a* which is disposed over the unfinished brim of the helmet 200*a*. In alternative embodiments, one or more adhesive-backed securing members may be as described above, except that they are integrally formed with the helmet edge trim 206*a*.

In certain embodiments, the dimensions of the cleat 210, such as the height, diameter, and thickness of the base 213, post 214, head 216, etc., may be standardized to define a common interface standard that multiple manufactures can design to.

Figure 20:
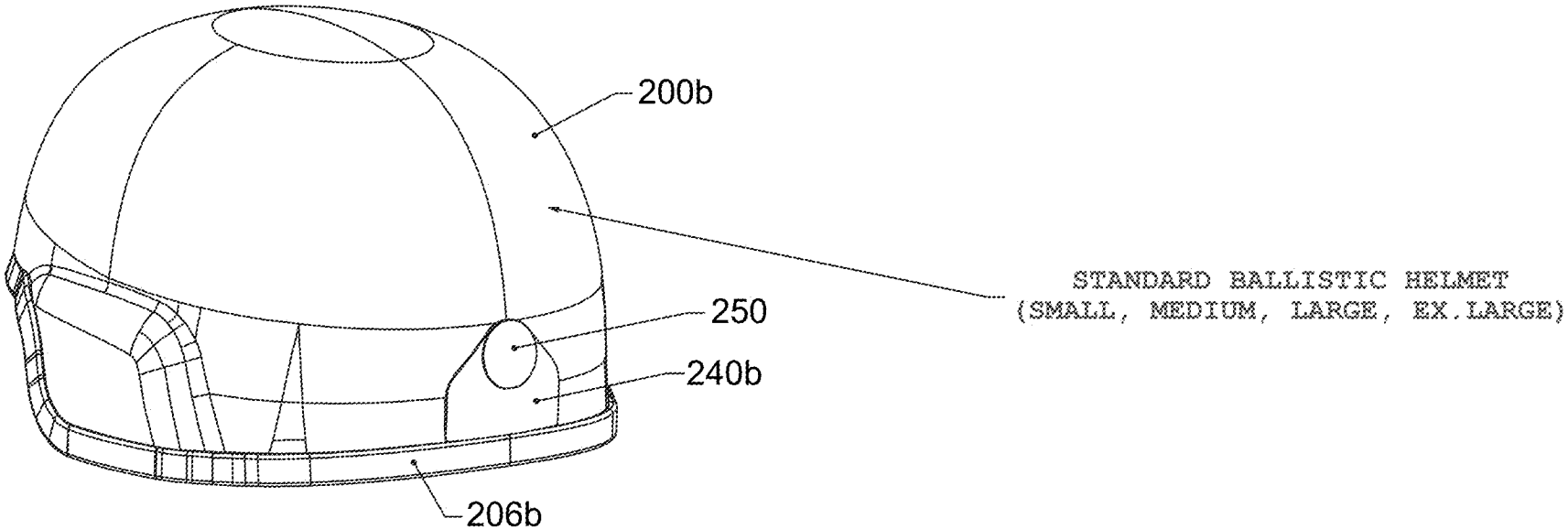
FIG. 20 is a helmet mount system according to a sixth exemplary embodiment.

Referring now to FIG. 20, an isometric view of an exemplary helmet 200*b* (e.g., which may be as described above) appears, having one mounting cleat 210 in accordance with this disclosure attached to the rear and central portion of the helmet. It will be recognized that the illustrated embodiment is exemplary only and that the embodiment of FIG. 1 can be adapted for positioning at any one or more locations on the helmet 200*b*, including, for example, the front, side(s), top, and elsewhere. The helmet 200*b* includes a shell member 202*b* having a brim 204*b*, e.g., an unfinished brim, and an edge trim piece 206*b* defining a channel 208*b* receiving the brim 204*b* to protect the brim 204*b* or otherwise to provide a finished edge.

Figure 21:
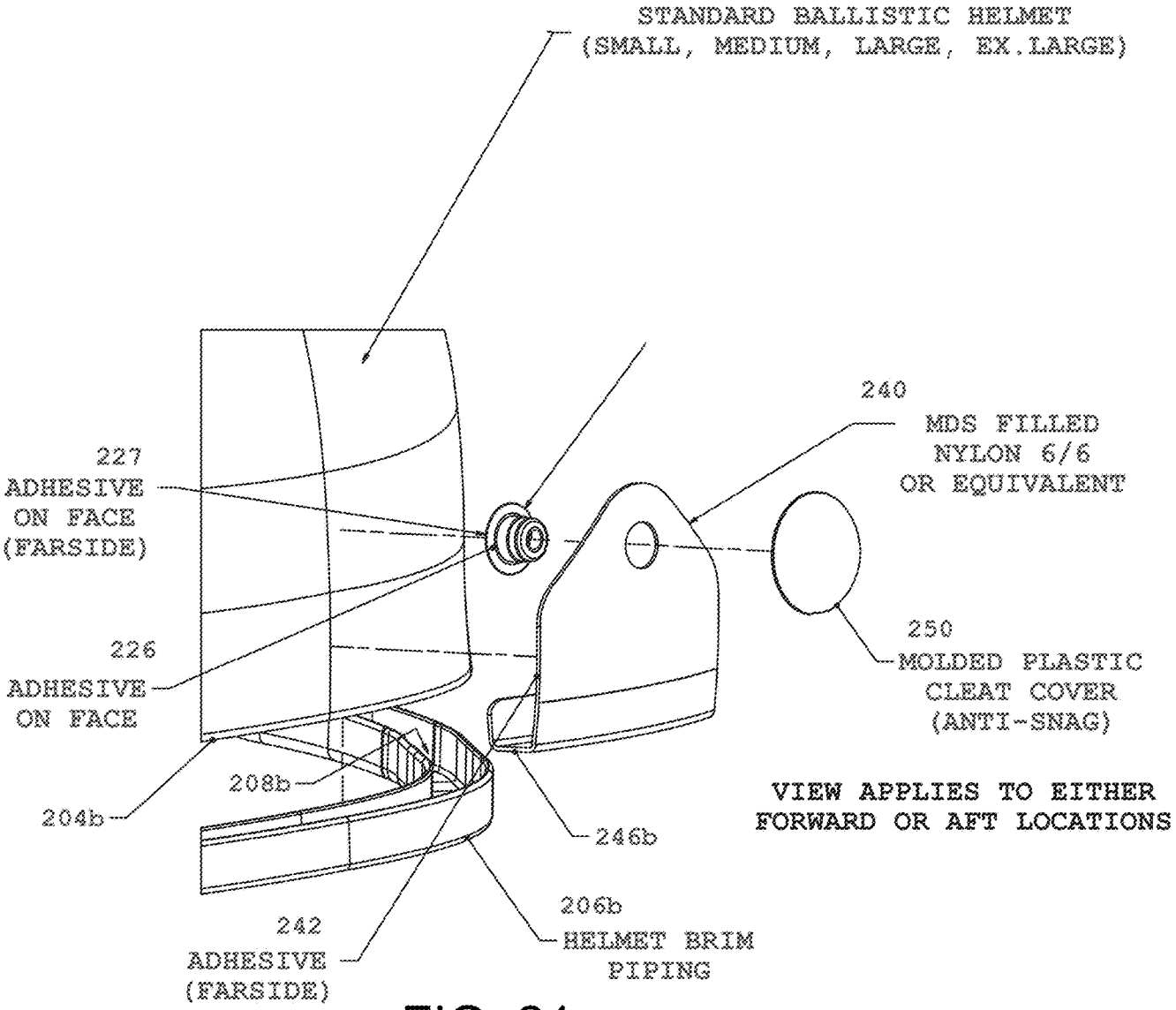
FIG. 21 is a fragmentary exploded view of the embodiment appearing in FIG. 20. Although shown for a cleat attached at the rear central portion of the helmet, the construction appearing in FIG. 21 applies to attachment to the front of the helmet or other location on the helmet.

FIG. 21 is a fragmentary, exploded view of the helmet and cleat system appearing in FIG. 20. The cleat system includes a cleat 210, which is secured to the helmet surface with an adhesive-backed securing member 240*b*, and may further include a cover 250. The cleat 210 and cover 250 appearing in FIGS. 20 and 21 may be as described above by way of reference to FIGS. 13-17.

In certain embodiments, the adhesive-backed securing member 240*b* is formed of a polymer material, such as a nylon material. In certain embodiments, the material is MDS filled nylon 6/6. An adhesive layer 242*b* is disposed on the helmet facing surface thereof. An aperture 244*b* is formed in the adhesive-backed securing member 240*b*. The base 213 extends through the aperture 244*b* and the adhesive-backed securing member 240*b* secures the flange 212 to surface of the helmet 200*b*. In certain embodiments, no adhesive is used between the helmet and the helmet facing surface of the cleat 210. In certain embodiments, an adhesive layer is used between the helmet and the helmet facing surface of the cleat 210.

Optionally, an adhesive layer may be provided on the outward facing surface 226 of the flange 212 to enhance the adhesive bond between the flange 212 and the adhesive layer 242*b*. The adhesive-backed securing member 240*b* includes a hook 246*b* which is secured around the brim 204*b*, and is disposed between the edge of the brim 204*b* and the edge trim piece 206*b*, within the channel 208*b*.

In certain embodiments, a cover 250 is provided which is removably attachable to the cleat 210 when the cleat 210 is not in use for attaching a helmet mounted-accessory device or mounting hardware. The cover 250 defines a receptacle that complementary with the shape of the cleat 210 and may include resilient members (not shown) removably engaging the cleat as described above by way of reference to the cover 150. The outer surface 254 of the cover 250 is preferably smooth and rounded to prevent snags when the helmet is worn in areas with brush or other snag hazards.

In the illustrated embodiment, the adhesive-backed securing member 240*b* is a separately formed piece, and is separate from a helmet edge trim piece 206*b* which is disposed over the unfinished brim of the helmet 200*b*. In alternative embodiments, one or more adhesive-backed securing members may be as described above, except that they are integrally formed with the helmet edge trim 206*b*.

In certain embodiments, the dimensions of the cleat 210, such as the height, diameter, and thickness of the base 213, post 214, head 216, etc., may be standardized to define a common interface standard that multiple manufactures can design to.

Figure 22:
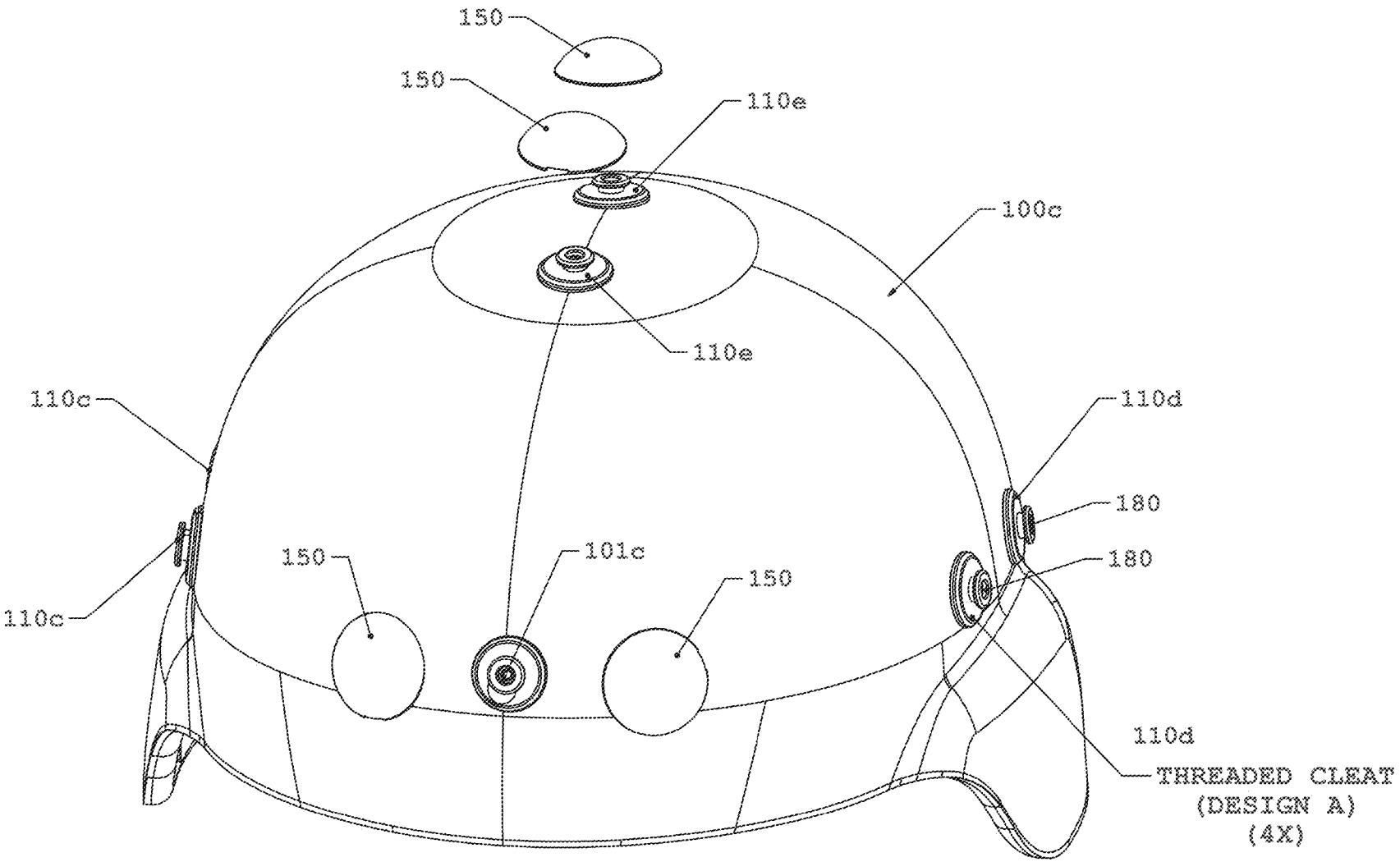
FIG. 22 is a helmet mount system according to a seventh exemplary embodiment.

Referring now to FIG. 22, there appears an exemplary helmet embodiment 100*c*, which includes 10 cleats 110 adhesively attached to the helmet 100*c*. In the configuration appearing in FIG. 22, there is a first pair of cleats 110*a* disposed on the front portion of the helmet 100*c* (shown with covers 150 attached; see uncovered from cleats 110*a* in FIG. 11) and a second pair of cleats 110*b* disposed on the rear portion of the helmet 100*c* (not shown in FIG. 22, see FIG. 11). A third pair of cleats 110*c* are disposed on the left side of the helmet (right side from the wearer's perspective), and a fourth pair of cleats 110*d* are disposed on the right side of the helmet (left side from the wearer's perspective). A fifth pair of cleats 110*e* is disposed on the top or crown of the helmet (hidden by attached covers 150; shown in phantom). In certain embodiments, it is contemplated that the cleats 110*a* are spaced apart and are on opposite sides of the median plane of the helmet 100*c*. Likewise, the cleats 110*b* are spaced apart and are on opposite sides of the median plane of the helmet 100*b*. The respective pairs of cleats 110*c*, 110*d*, and 110*e* are spaced apart and are disposed on opposite sides of a frontal plane passing through the helmet 100*c*.

Figure 23A:
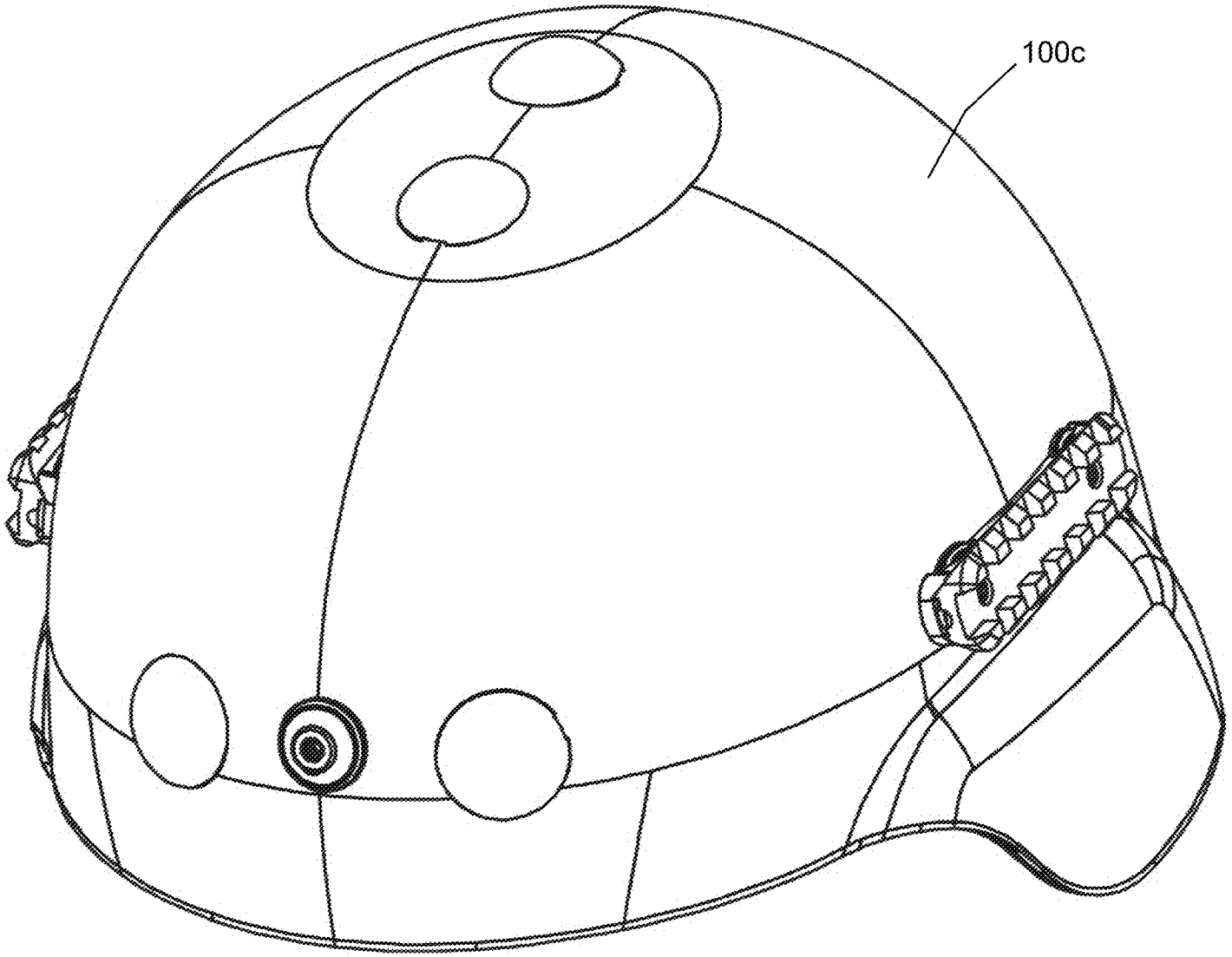
FIG. 23A is a helmet mount system according to an eighth exemplary embodiment.
Figure 23B:
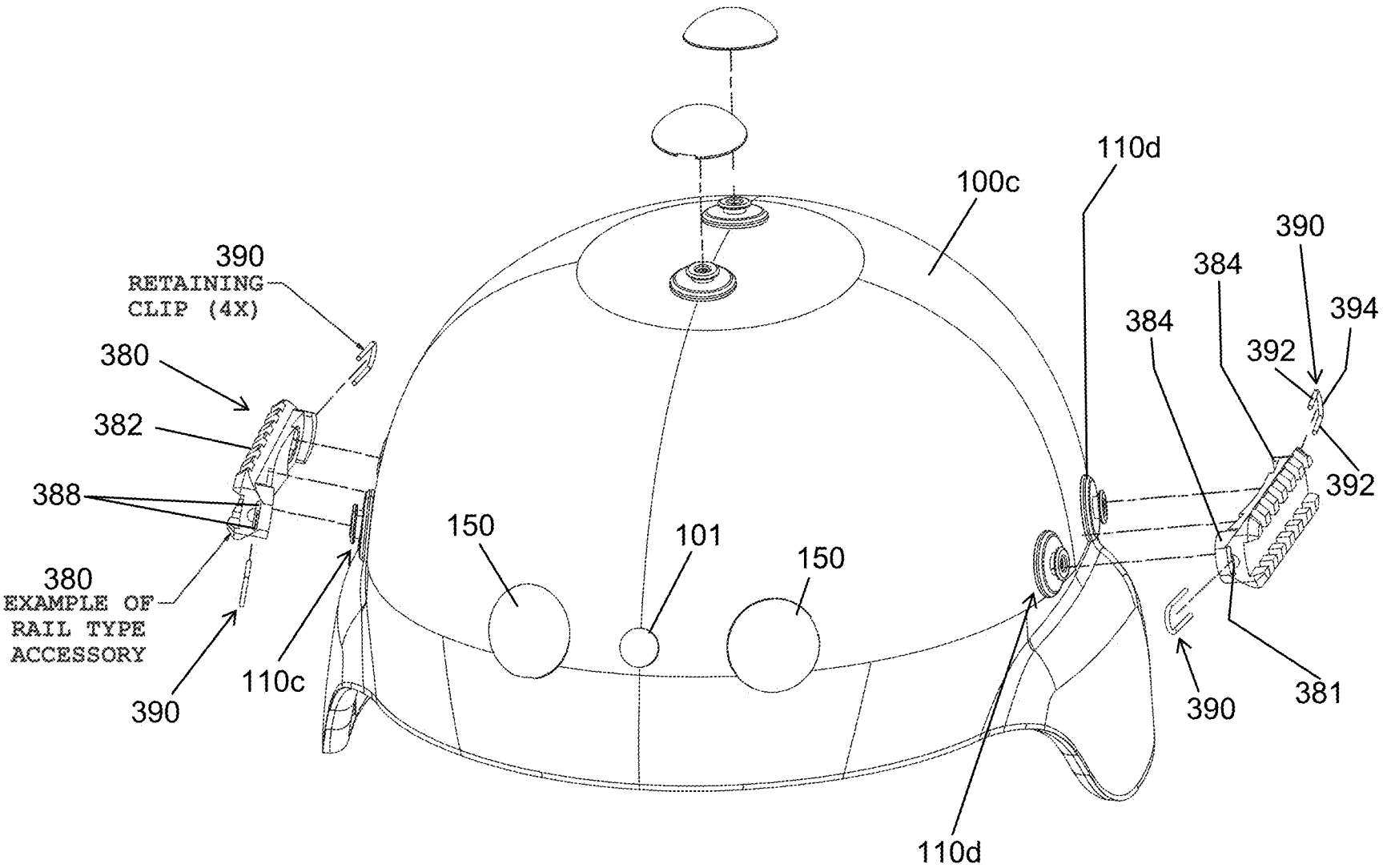
FIG. 23B is a partially exploded view of the embodiment appearing in FIG. 23A.

Referring now to FIGS. 23A and 23B the helmet 100*c* is illustrated with accessory rail members 380 attached to each of the pairs of cleats 110*c* and 110*d* (see FIG. 11). The accessory rail members 380 include an accessory interface portion 382 for attaching a device (not shown) such as a flashlight, IR illuminator, or other helmet-worn accessory device. In the illustrated embodiment, the accessory interface portion 382 is configured as a section of Picatinny-type accessory rail, e.g., in accordance with such as NATO Accessory Rail (NAR), STANAG 2324, MIL-STD 1913, or like accessory rail standard as would be understood by persons skilled in the art. It will be recognized that other accessory rail interface types may be employed as well.

The accessory rail member 380 further includes sidewalls 384 at opposing ends thereof and helmet-facing receptacles 386 which are facing and aligned with, and sized to receive the respective pair of cleats 110. Each sidewall has a pair of openings 388 for receiving a clip 390. The clip 390 includes a pair of legs 392 adjoined by a crown 394. When the legs 392 of the clip 390 are inserted into the openings 388, the legs 392 are disposed on opposite sides of the post 114 between the gap or channel defined between the base 112 and the head 116 of the cleat 110 to secure the accessory rail member 380 to the cleats 110. In certain embodiments, the crown 394 is received within a complementary slot or recess 381, and may be retained therein by friction fit, snap fit, press fit, etc. In certain embodiments, a scallop or cutout 383 is provided adjacent to the slot 381 to facilitate removal of the clip 390, e.g., for using a screwdriver or other tool to pry the clip 390 free when it is desired to remove the accessory rail member from the helmet.

Figure 24A:
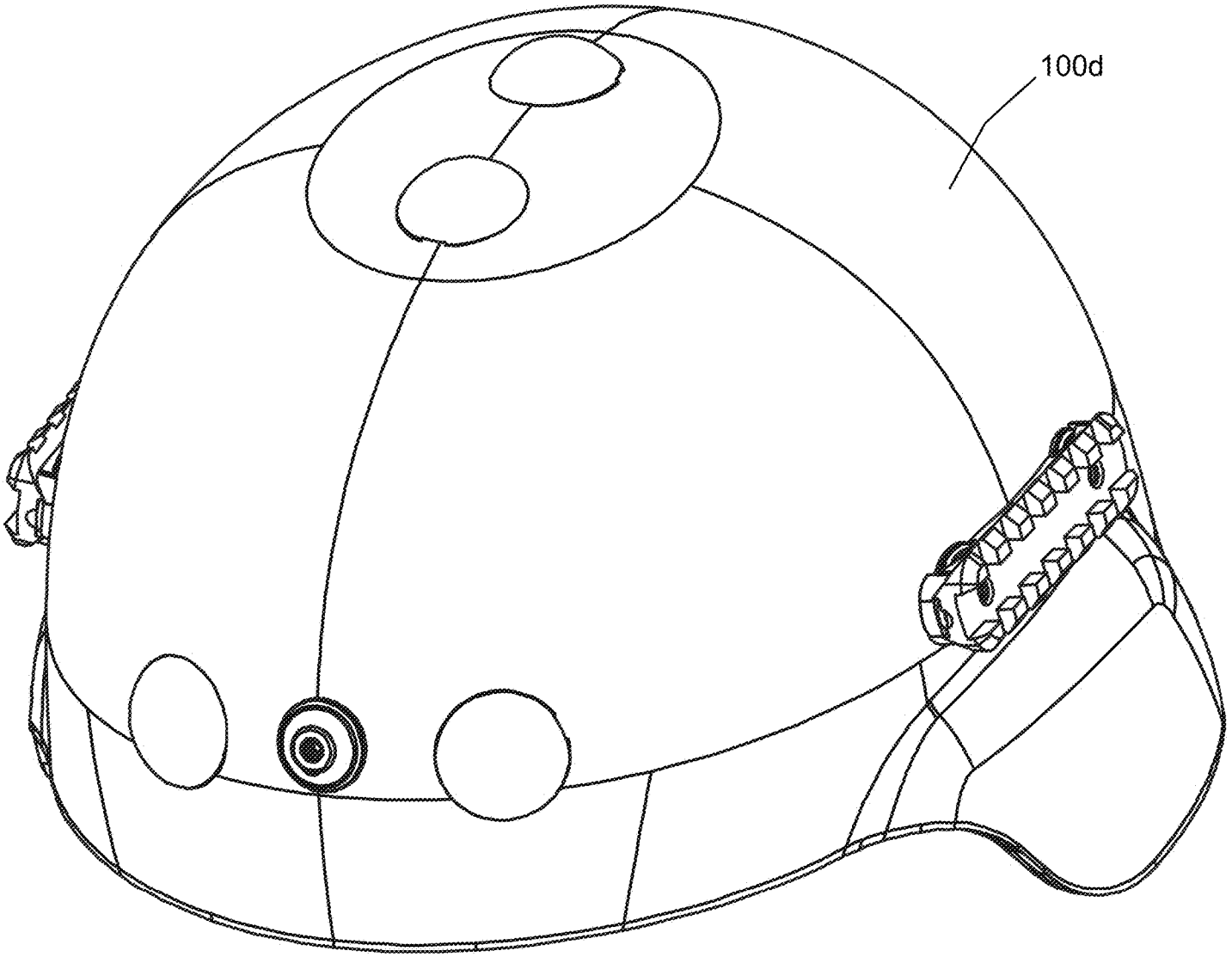
FIG. 24A is a helmet mount system according to a ninth exemplary embodiment.
Figure 24B:
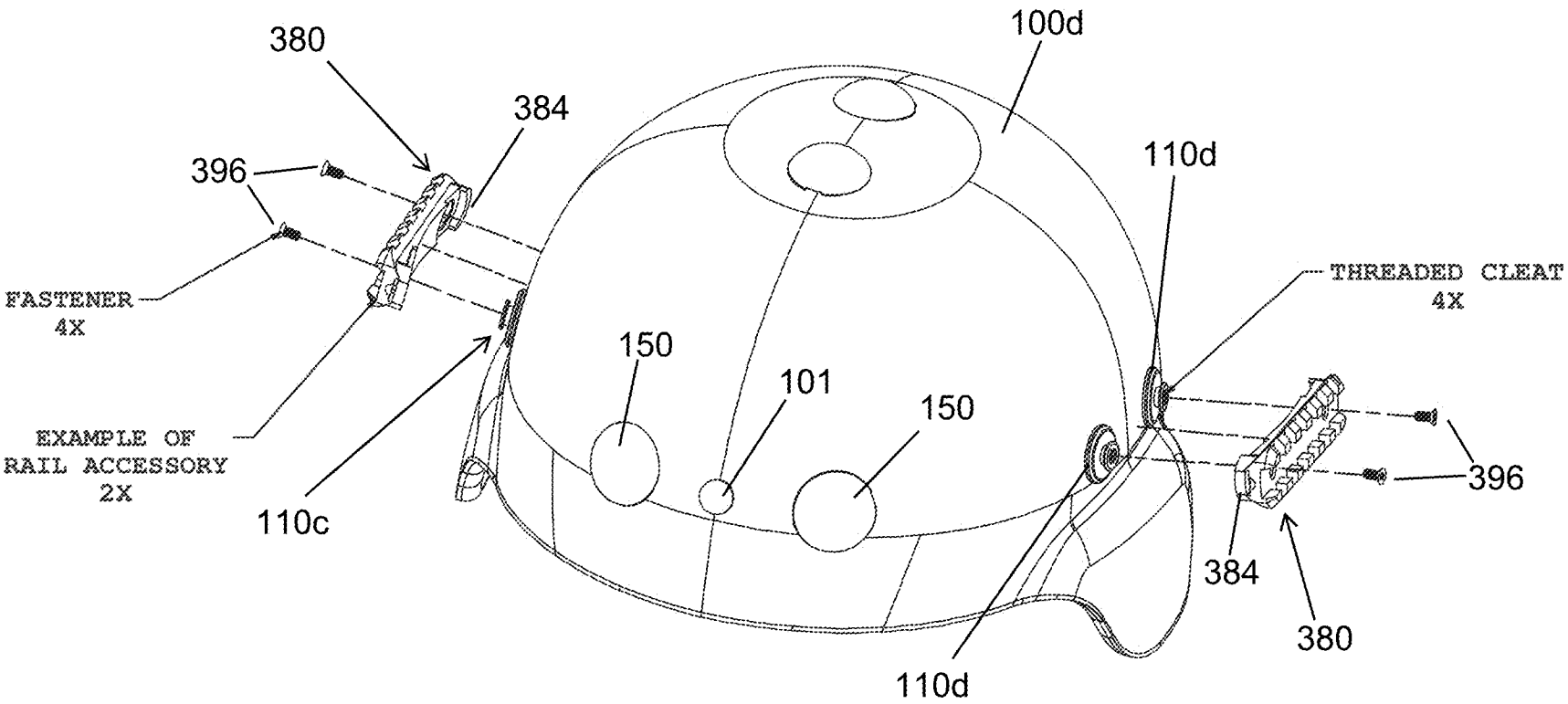
FIG. 24B. is a partially exploded view of the embodiment appearing in FIG. 24A.
Figure 25A:
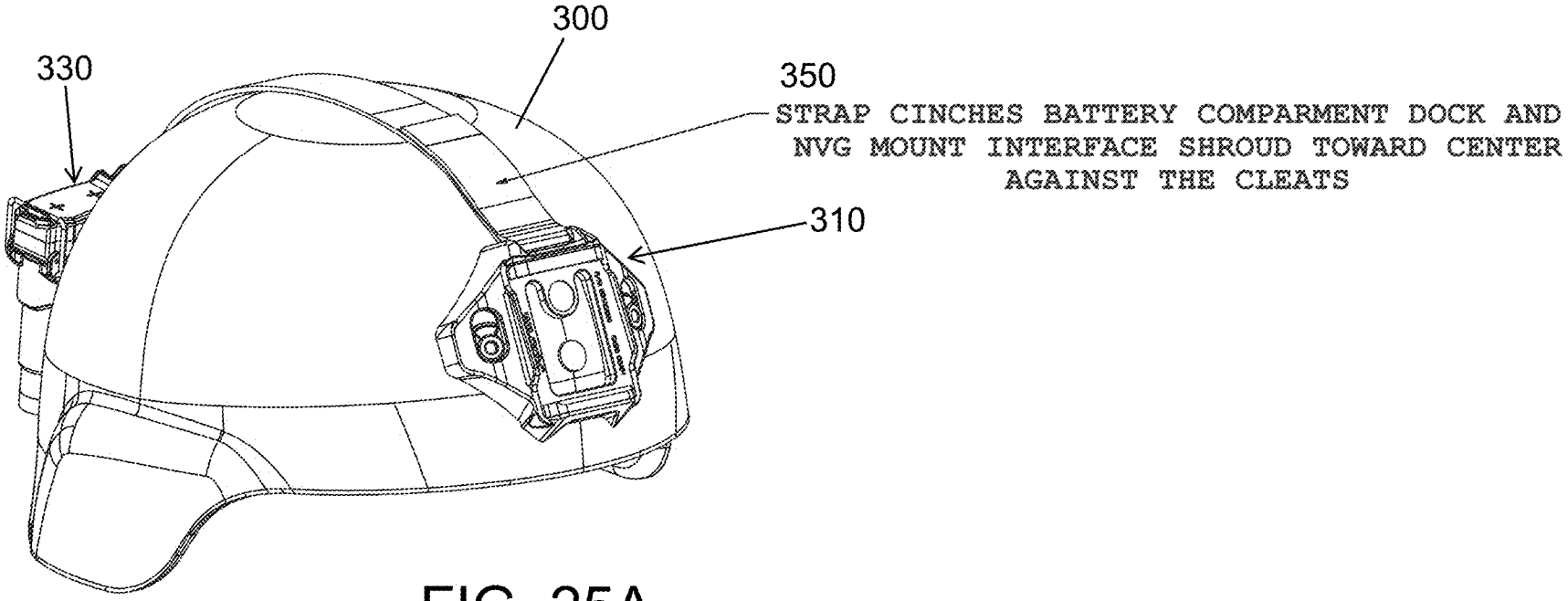
FIG. 25A is a helmet mount system according to a tenth exemplary embodiment.
Figure 25B:
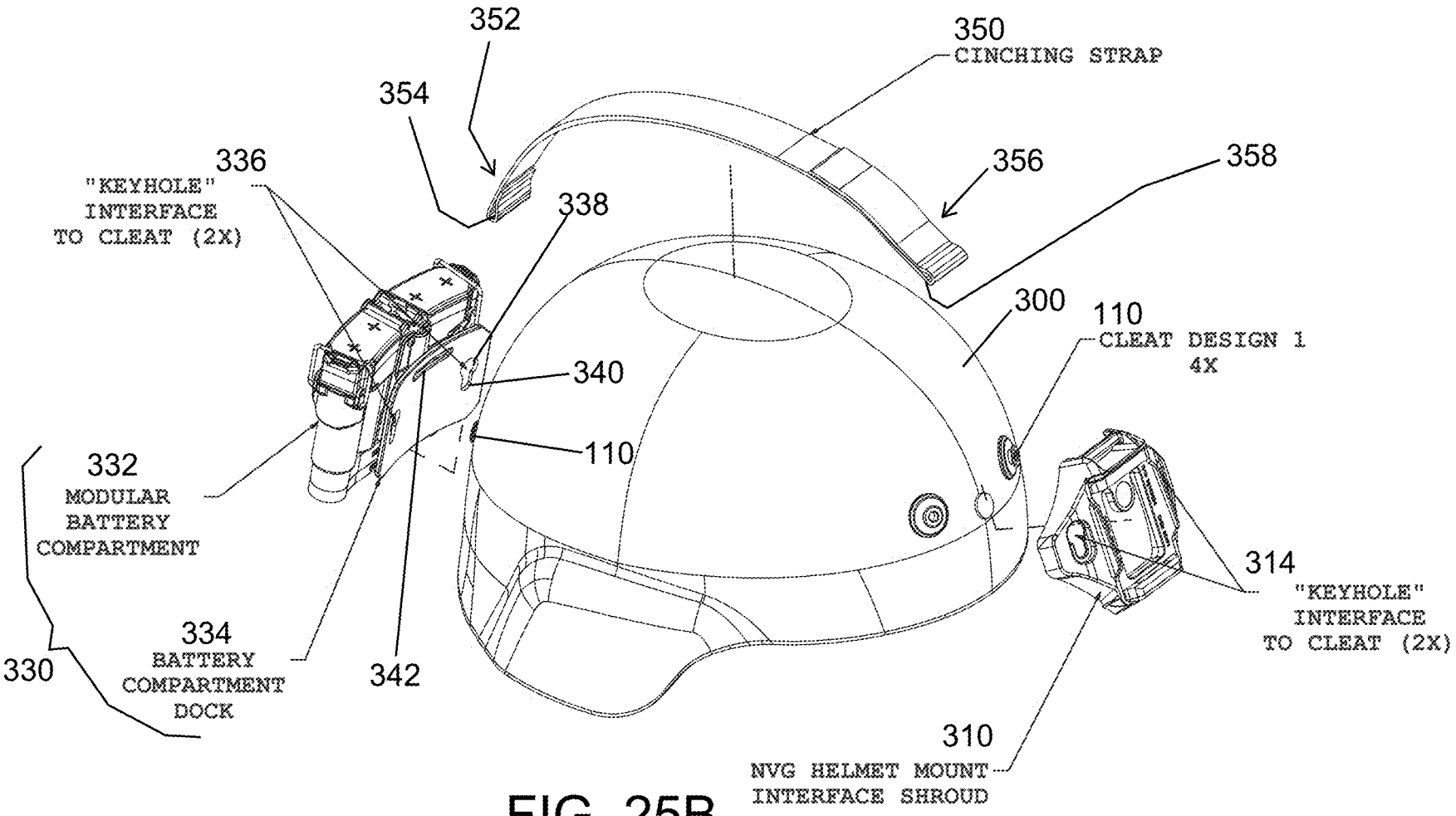
FIG. 25B is an exploded view of the embodiment appearing in FIG. 25A.

FIGS. 24A and 25B illustrate the helmet embodiment 100*d*, which may be as described above by way of reference to FIGS. 23A and 23B, except wherein the retaining clips 390 have been replaced with threaded fasteners 396 which engage the threaded inserts 180.

Again, in the event the present development is employed with existing helmets that have one or more predrilled holes, a ballistic grade screw 101 should be screwed into such pre-existing screw holes.

In certain embodiments, a rail system (which may be a Picatinny-type rail as described above or other rail type) is attached to the side of the helmet, which can also be used to support a helmet suspension system and chin and neck straps, which would lead to having no external holes in the helmet.

Figure 25C:
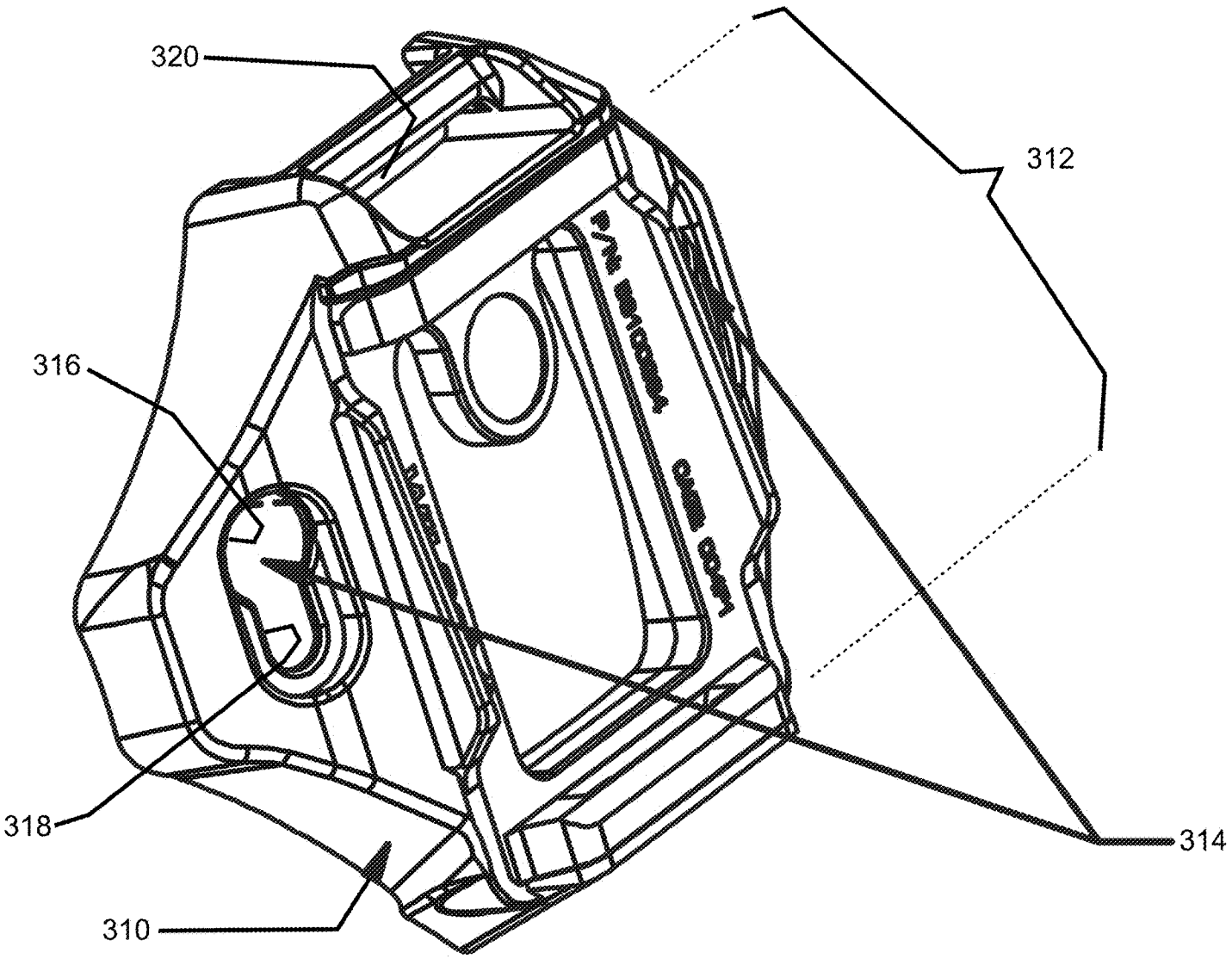
FIG. 25C is an isometric view of a mounting interface portion of the embodiment appearing in FIG. 25A.

FIGS. 25A-25C disclose an exemplary helmet 300 having a 1st pair of cleats 110 on a front portion of the helmet and a 2nd pair of cleats 110 on a rear portion of the helmet. It will be recognized that the embodiment appearing in FIGS. 25A-25C may be adapted for use with the cleats 210, as described above, in place of the cleats 110.

Figure 26A:
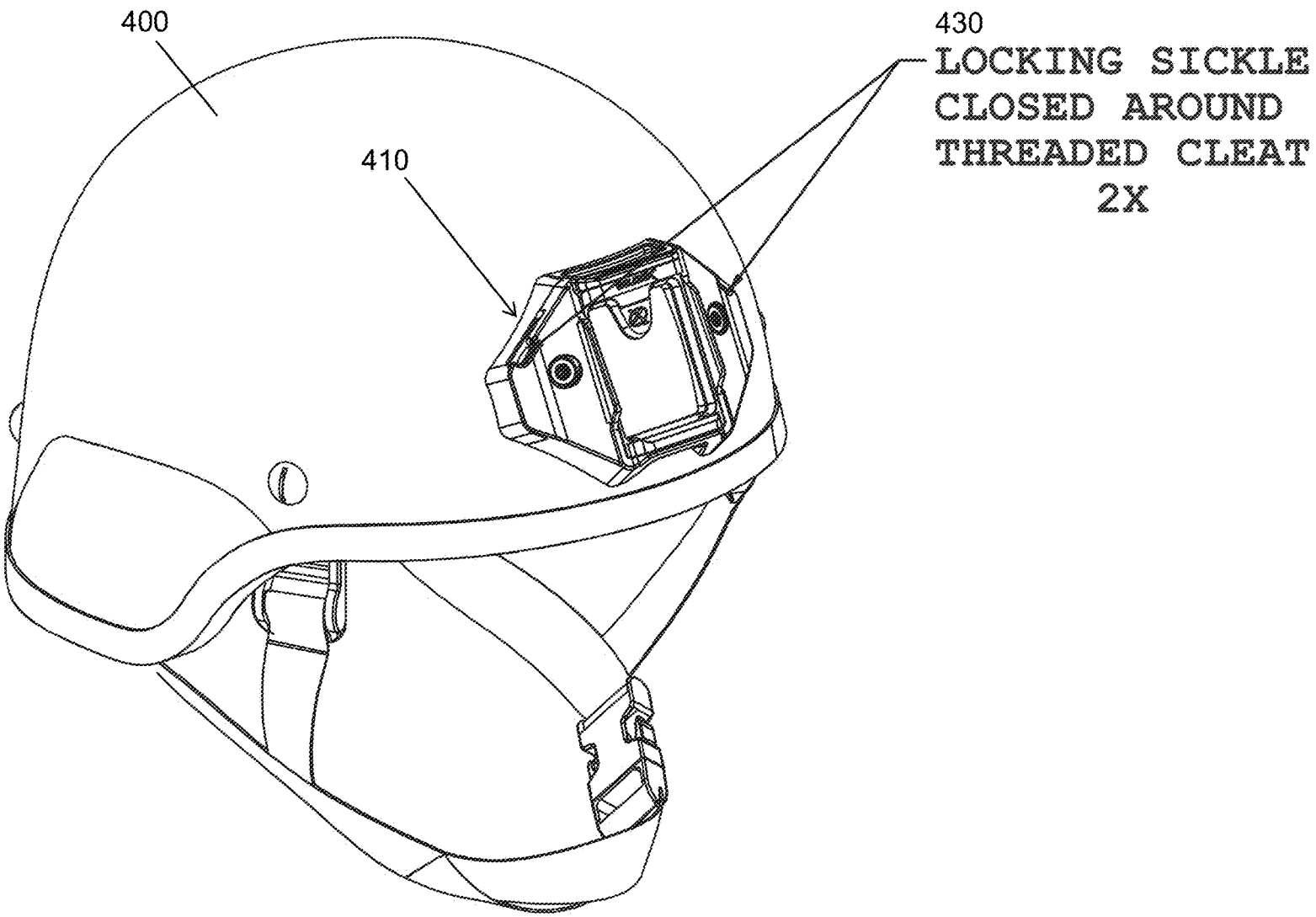
FIG. 26A is a helmet mount system according to an eleventh exemplary embodiment.
Figure 26B:
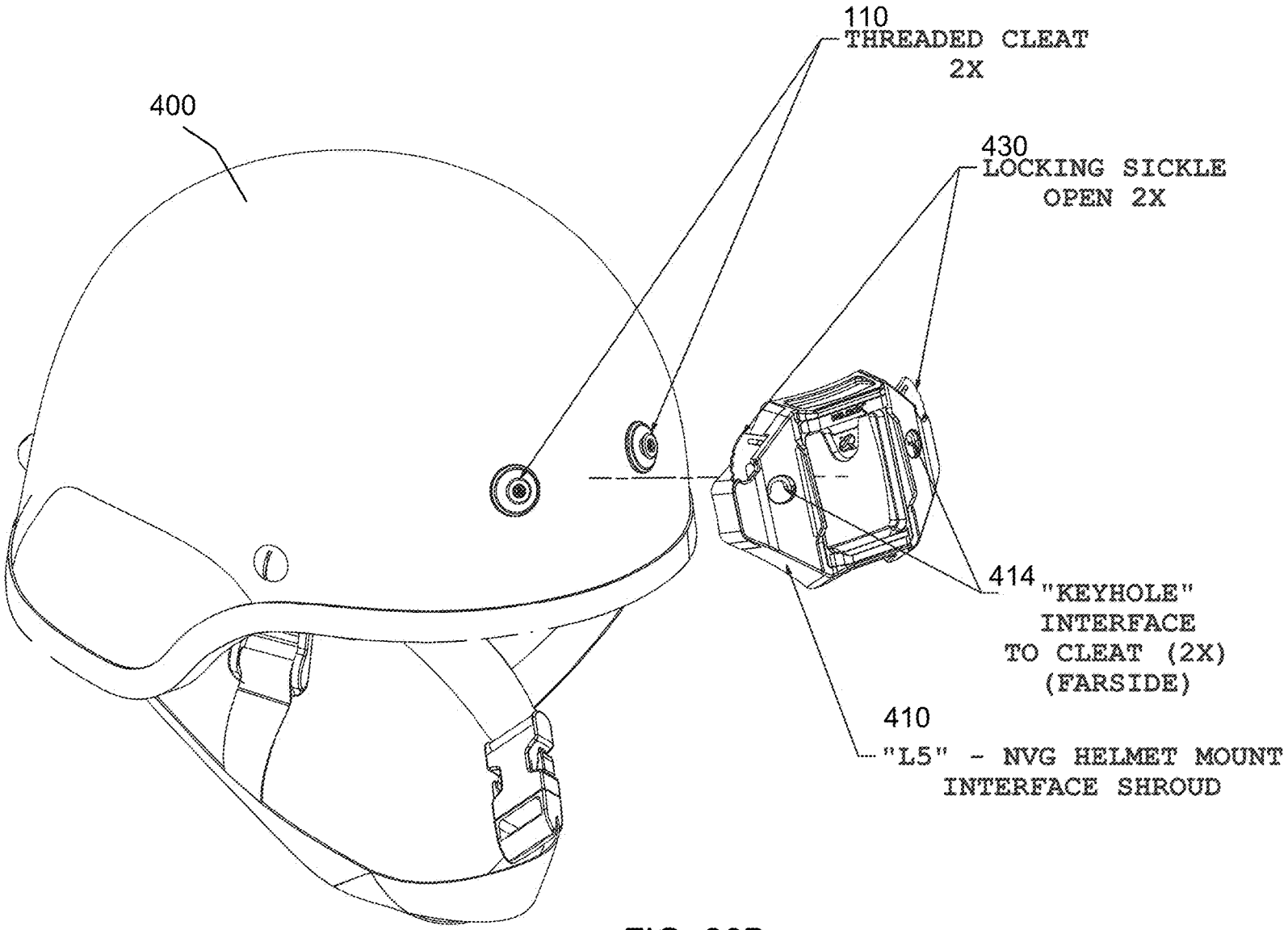
FIG. 26B is an exploded view of the embodiment appearing in FIG. 26A.
Figure 26C:
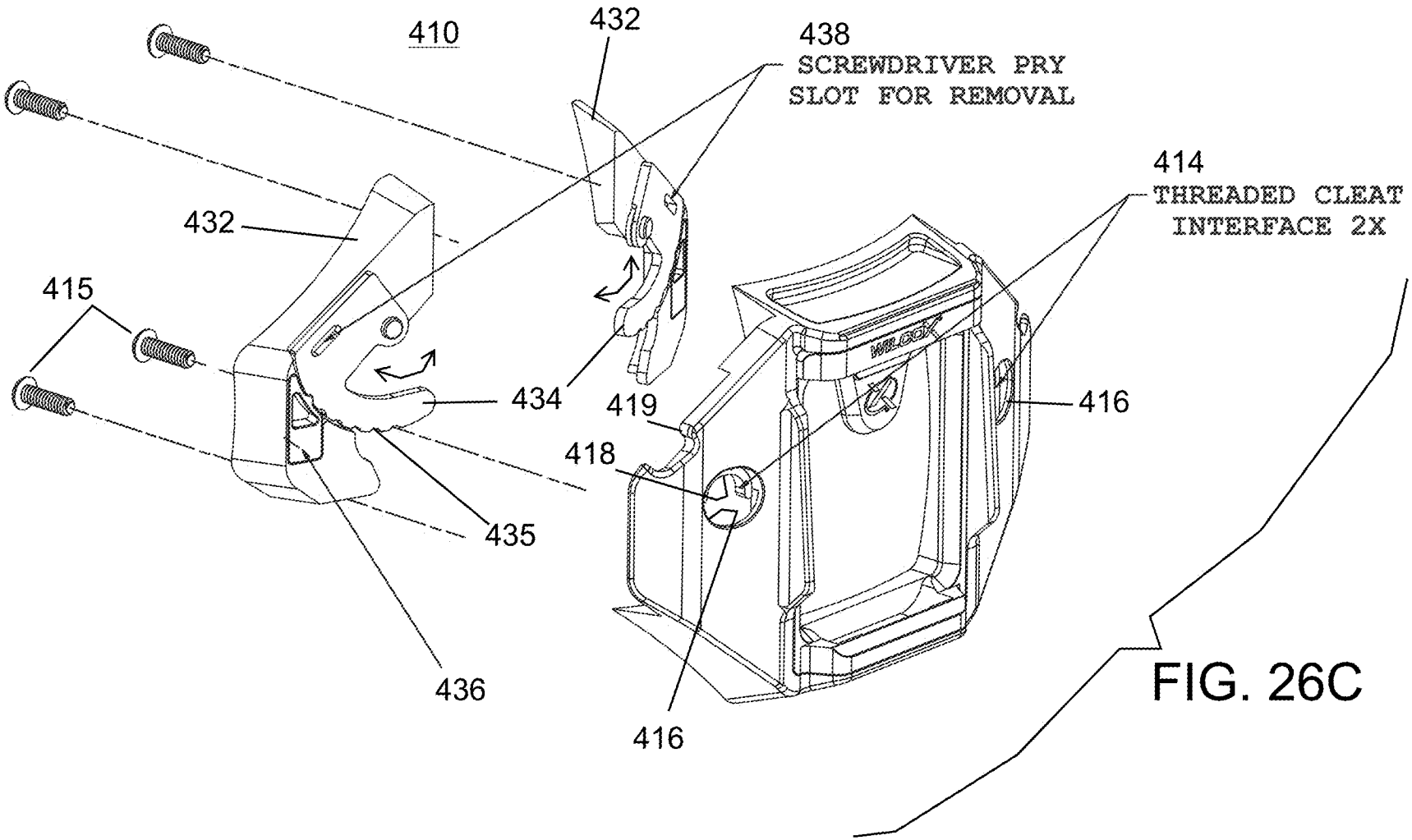
FIG. 26C is a partially exploded view of the helmet mount interface of the embodiment appearing in FIG. 26A.
Figure 26D:
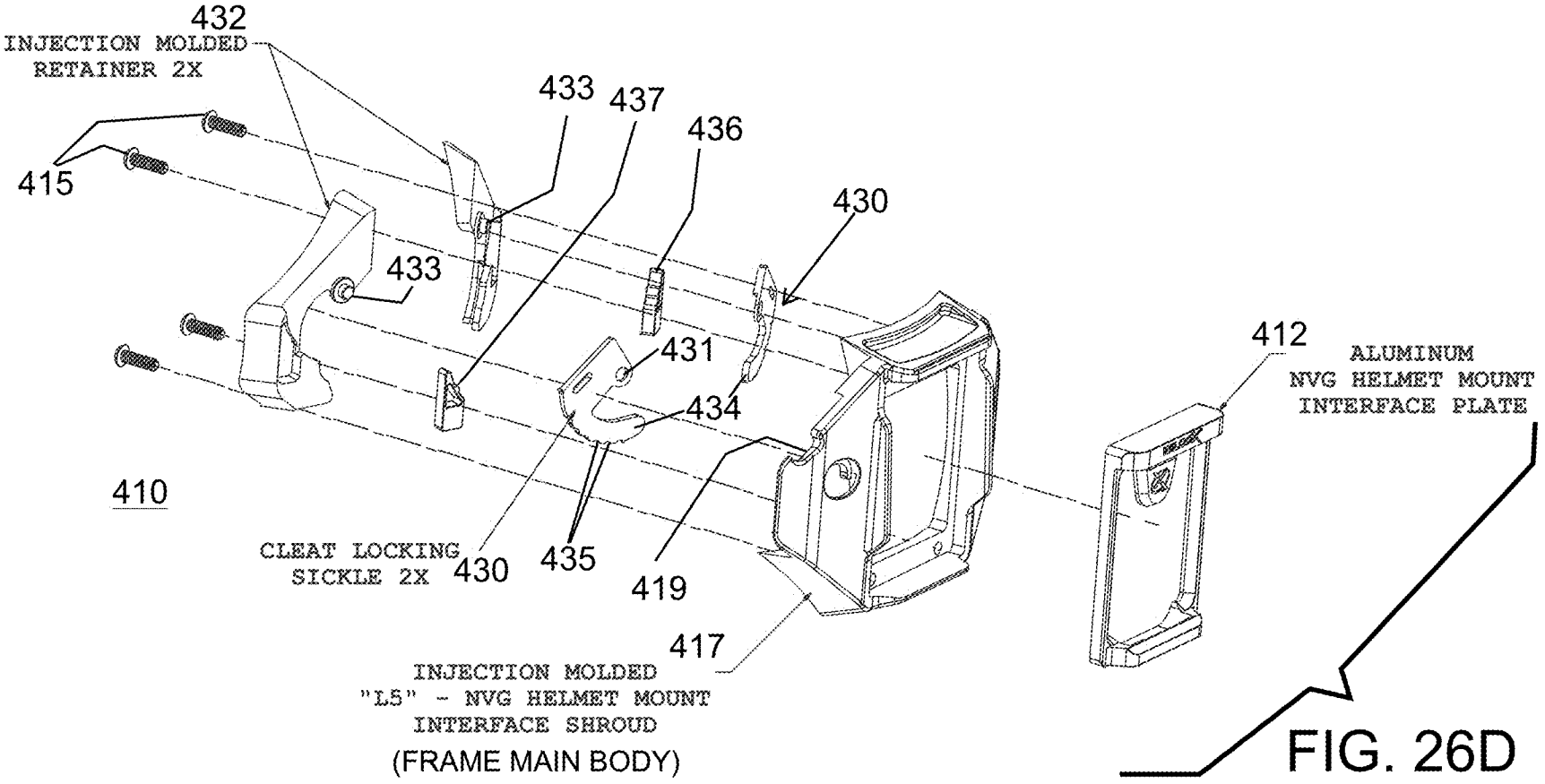
FIG. 26D is an exploded view of the helmet mount interface of the embodiment appearing in FIG. 26A.
Figure 27A:
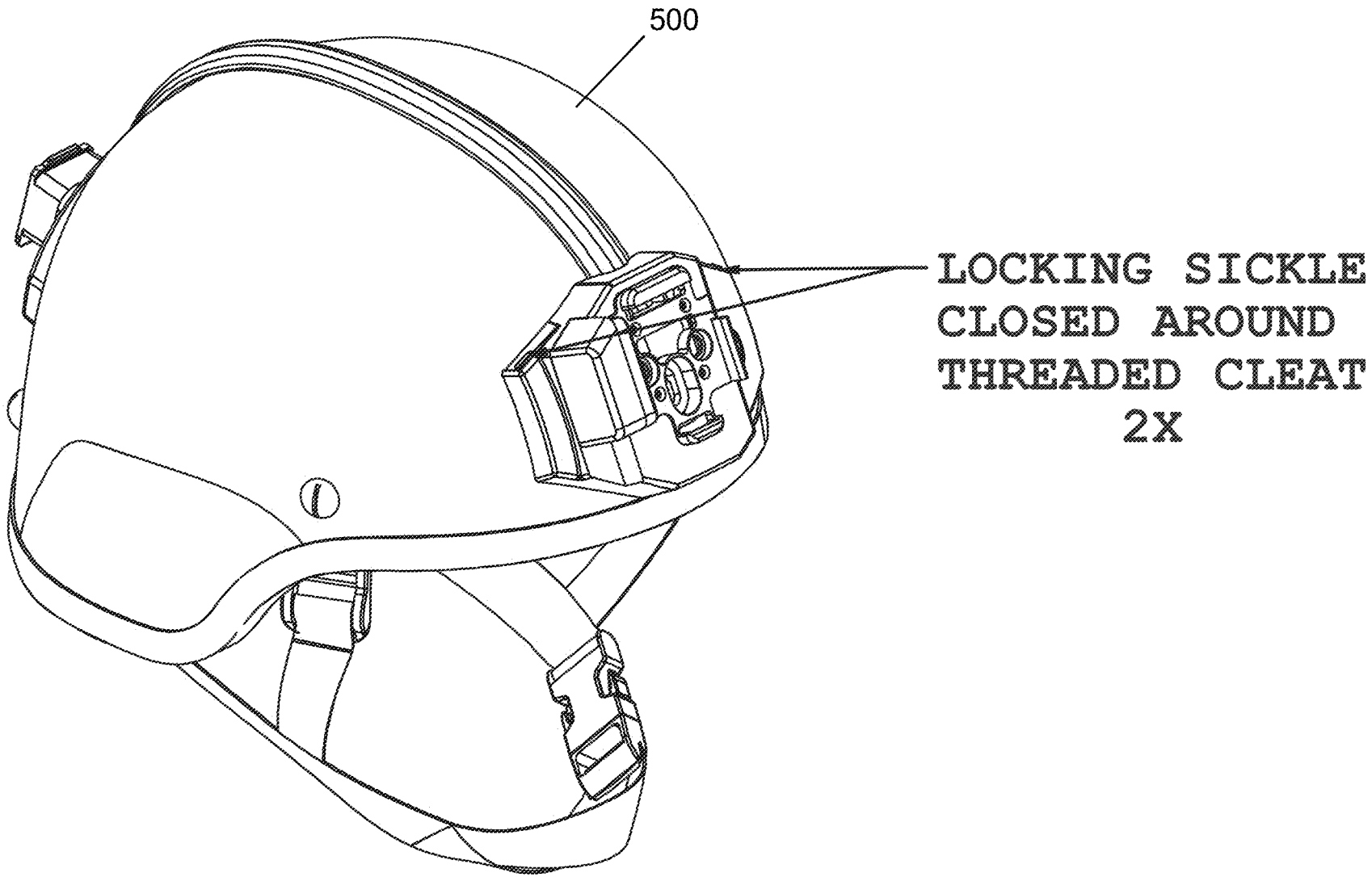
FIG. 27A is a helmet mount system according to a twelfth exemplary embodiment.
Figure 27B:
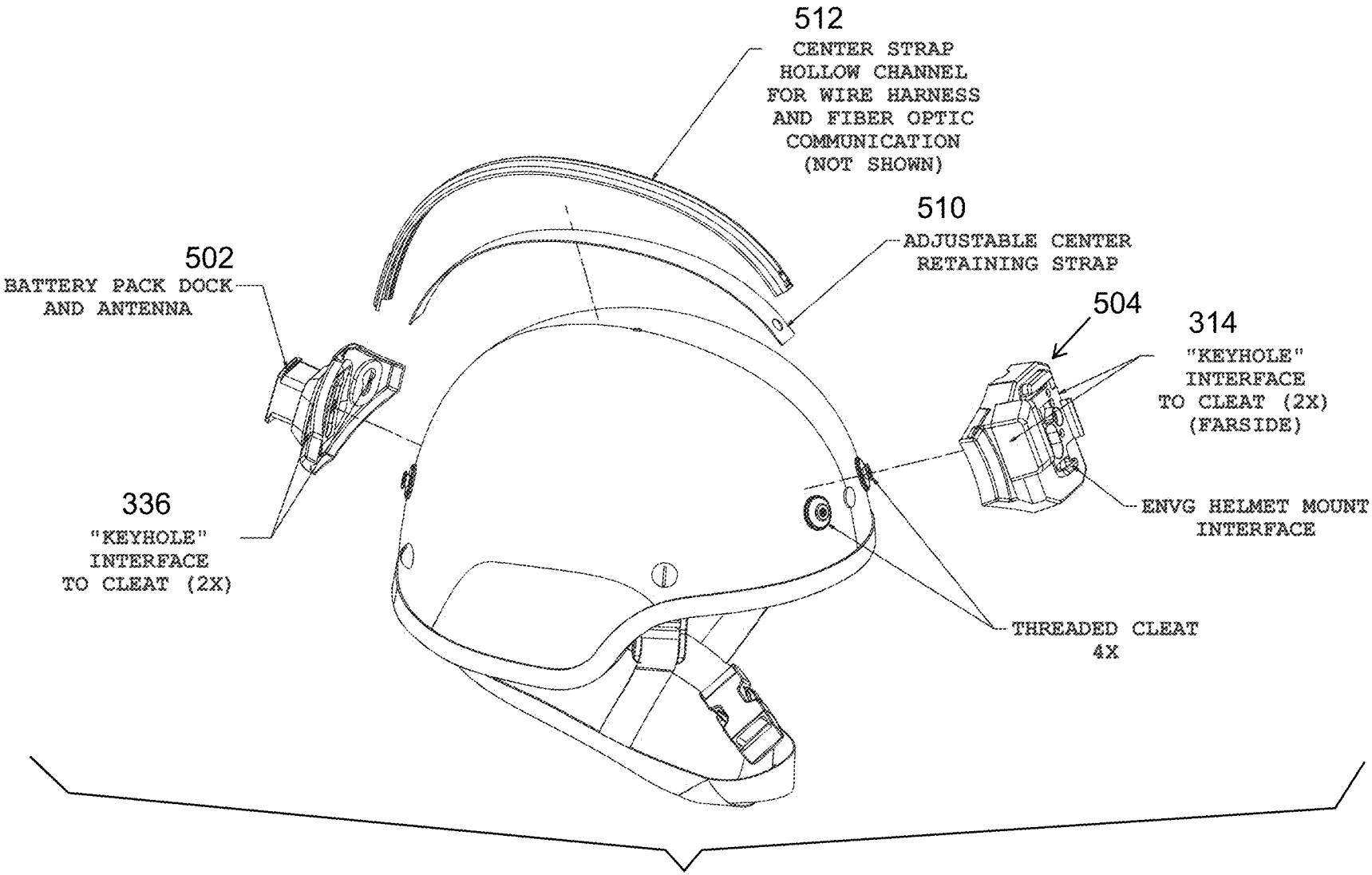
FIG. 27B is an exploded view of the embodiment appearing in FIG. 27A.
Figure 27C:
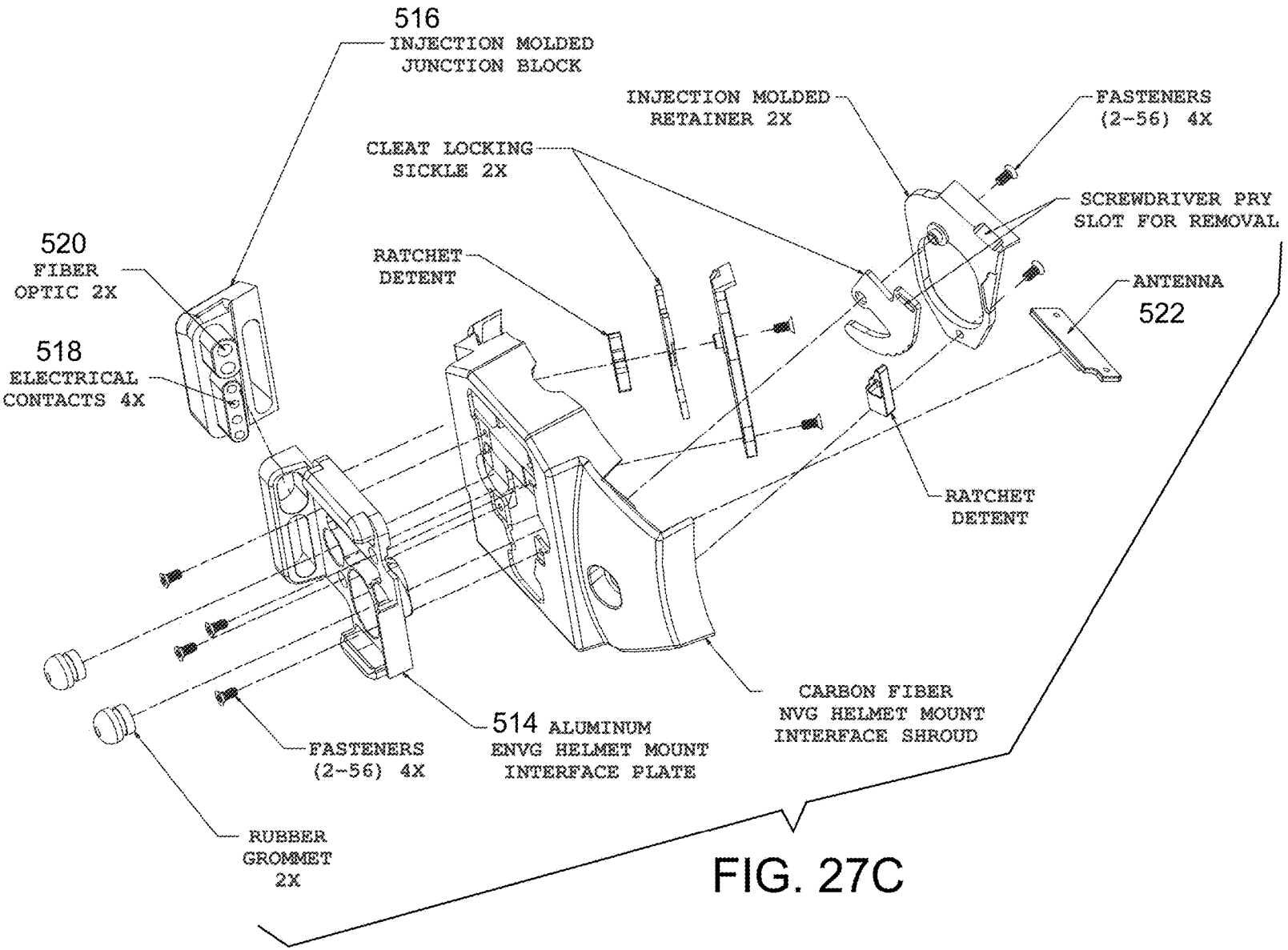
FIG. 27C is an exploded view of the helmet mount interface of the embodiment appearing in FIG. 27A.
Figure 27D:
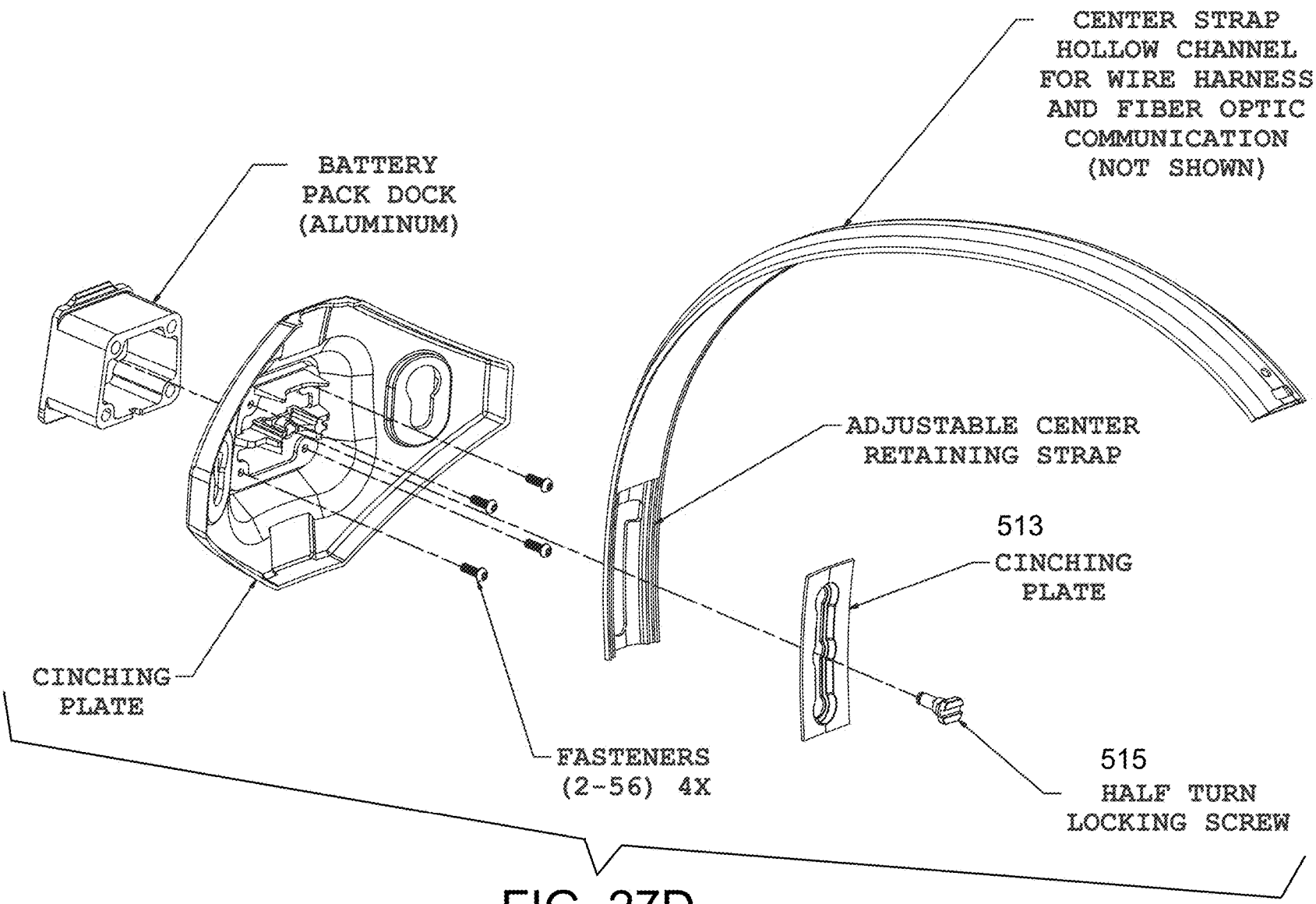
FIG. 27D is an exploded view of the battery dock and retaining strap of the embodiment appearing in FIG. 27A.

A shroud 310 is attached to the front set of cleats 110. A battery pack 330 is attached to the rear set of cleats 110. The shroud 310 includes a helmet mount interface portion 312 secured to a frame 313, wherein the helmet mount interface portion 312 is adapted to removably attach a helmet mount such as a night vision system helmet mount available from Wilcox Industries Corp. of Newington, N.H. The interface portion 312 may be secured to the frame 313 via threaded fasteners, e.g., threaded fasteners passing through the frame and received within complementary, blind screw holes in the interface plate 312 (not shown), e.g., in the manner shown in FIGS. 26C and 26D discussed below. Although the illustrated embodiment is described by way of reference to a modular shroud wherein the frame and interface plate are separately formed components, it will be recognized that the present invention is also amendable to shrouds wherein the helmet interfacing frame and the helmet mount interface are unitary.

A pair of elongate slots defining keyhole interfaces 314 on the shroud 310 include an enlarged diameter upper opening 316 sized to receive the enlarged diameter head 116 of the cleat 110. Each keyhole interface 314 also includes a lower, narrow diameter slot 318 which is sized to receive the post 114.

The battery pack 330 includes a battery compartment 332 for housing one more battery cells and a battery compartment dock 334 removably attaching to the battery compartment 332. The dock 334 includes a pair of elongate slots defining keyhole interfaces 336. Each keyhole interface 336 includes an enlarged diameter opening 338 sized to receive the head 116 and a narrow slot portion 340 receiving the post 115.

In operation, the shroud 310 is placed over the front cleats 110 so that the cleat heads 116 of the front cleats 110 pass through the openings 316 and the battery compartment dock 334 is placed over the rear cleats 110 so that the cleat heads 116 of the rear cleats 110 pass through the openings 338. The shroud 310 and the battery compartment dock 334 are each then slid upward, e.g. by cinching of a strap 350 connecting the shroud 310 and the battery dock 334.

The cinch strap 350 includes a first end 352 engaging the battery compartment dock 334, e.g., via a loop 354 which engages a slot 342 on the dock 334. A cinch strap 350 also includes a second end 356 engaging the shroud 310, e.g., via a loop 358 engaging a slot 320 on the shroud 310. Tension on the cinch strap 350 retains the posts 115 of the cleats 110 within the narrow diameter portion of the keyhole interfaces 314, 336.

In certain embodiments, the tension in the strap 350 may be provided by manually pulling the free end 356 and securing the strap in a tensioned state with a fastener such as a hook and loop type fastener 360. In alternative embodiments, the length of the strap 350 may be adjusted by a ratchet adjustment mechanism (not shown) as would be understood by persons skilled in the art.

Referring now to FIGS. 26A-26D, there appears a further embodiment wherein a helmet 400 includes a shroud 410 attached to a front portion of the helmet. It will be recognized that the embodiment appearing in FIGS. 26A-26C may be adapted for use with the cleats 210, as described above, in place of the cleat 110.

The shroud 410 is attached to the cleats 110. The shroud 410 includes a helmet mount interface portion 412 secured to a frame 413, wherein the helmet mount interface portion 412 is adapted to removably attach a helmet mount such as a night vision system helmet mount available from Wilcox Industries Corp. of Newington, N.H. The interface portion 412 may be secured to the frame 413 via threaded fasteners 415 passing through the frame 413 and received within complementary, blind screw holes in the interface plate 412. Although the illustrated embodiment is described by way of reference to a modular shroud wherein the frame and interface plate are separately formed components, it will be recognized that the present invention is also amendable to shrouds wherein the helmet interfacing frame and the helmet mount interface are unitary.

A pair of spaced apart keyhole interfaces 414 is provided, each including an enlarged diameter lower portion 416 and an upper, narrow diameter portion 418. The diameter of the lower portion 416 is sized to receive the head 116 of the cleat 110 and the width of the narrow diameter portion 418 is sized to receive the post 114 of the cleat 110, such that the narrow portion 418 is received within the cleat channel 115.

A pair of locking sickle members 430 are pivotally carried on the shroud 410. Each locking member 430 includes a proximal end pivotally attached to the shroud 410 via an opening 431 receiving a pivot pin 433 on a retainer 432. The retainer, in turn, is secured to the main body 417 of the shroud 410.

Each locking sickle member 430 also includes a generally sickle shaped latching member 434 at its distal end. Pivoting movement of the locking sickle members 430 in the direction of the arrows appearing in FIG. 26C moves the locking sickle member 430 between the locked position (see FIG. 26A) and the unlocked position (see FIG. 26B), wherein the latching member 434 is received within the channel 115 of the cleat 110 to thereby secure the shroud 410 to the cleats 110.

The latching members 434 include a series of indents 435 which engages a resilient detent member 436 having a protrusion 427 which in turn engages an aligned one of the indents 435 to secure the locking sickle member 430 in a desired position. In certain embodiments, the detent member 436 is made resilient by forming the resilient detent member 436 of a flexible and resilient material. In alternative embodiments (not shown), the resiliency may be provided by a captured spring.

In certain embodiments, a pry slot 438 is formed in the locking sickle member 430 to facilitate moving the locking sickle member 430 from the locked position to the unlocked position using a screwdriver or like pry tool. The slot 438 is accessible via a cutaway 419 in the frame main body 417. In certain embodiments, the profile of the series of intents 433 and/or the profile of the protrusion 437 is formed to provide a ratchet like mechanism, e.g., wherein movement of the indents 435 past the protrusion 437 is facilitated when the locking sickle member 430 is being moved from the unlocked position to the locked position and wherein there is increased resistance to movement of the indents 435 past the protrusion 437 when the locking sickle member 430 is being moved from the locked position to the unlocked position.

FIG. 27A-27D disclose an exemplary helmet 500 having a battery dock 502 attached to a rear pair of cleats 110 (or alternately 210) and a shroud 504 with an enhanced night vision goggle (ENVG) helmet mount interface 506. The shroud 504 includes spaced apart keyhole interfaces (414) and cleat locking sickle members with ratchet detents for engaging the cleats 110. The keyhole interfaces and cleat locking sickle members are as described above by way of reference to FIGS. 26A-26D. The battery dock 502 includes a cinching plate 508 having keyhole interfaces (336) as described above by way of reference to FIGS. 25A-25C.

The battery dock 502 and the shroud 504 are connected to opposite ends of a center retaining strap 510 running generally along the midline of the helmet. Upward tension in the retaining strap secures the cinching plate to the cleats and retains the cleat posts within the narrow width portion of the respective keyhole interfaces. A center strap hollow channel 512 is disposed over the strap 510. The rear end of the strap has an elongate opening and clinching plate 513 which cooperates with a locking screw 515 to secure the strap a one of a plurality of positions to provide gross adjustment of the strap. In certain embodiments, three positions are provided, e.g., small, medium, and large to accommodate different helmet sizes.

The center strap hollow channel is configured to receive a wiring harness, electrically conductive cables, and/or optical fibers, etc. for electrically and/or optically coupling the battery pack to the ENVG helmet mount interface, for the communication power, electrical signals, and/or optical signal between the battery pack dock and an ENVG device attached to a helmet mount (not shown) secured to the helmet mount interface.

In certain embodiments, the ENVG helmet mount interface plate 514 is secured to the shroud 504 (e.g., via threaded fasteners), which in turn includes an optical and electrical junction box 516 attached thereto for providing an electrical interface (contacts) 518 and an optical interface 520 between the helmet wiring and optical fiber harness within the hollow channel 512 of the center strap 510 and an attached ENVG helmet mount (not shown). The interface shroud 504 may be formed of a polymer composite materials such as a carbon fiber reinforced polymer composite. The helmet mount interface plate 514 may be formed of a metal such as aluminum. An antenna 522 may be provided on the shroud 504 for electrically coupling to a transceiver of a wireless communication system.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims and equivalents thereof.

What is claimed is:

1. A mounting cleat assembly for attaching a device to a helmet, the mounting cleat assembly comprising:

a base member configured to be attached with an adhesive to an associated helmet exterior surface;

a threaded insert at least partially received within a cavity formed in the base member, the threaded insert defining an internally threaded lumen;

a centrally disposed hollow post portion extending away from the associated helmet exterior surface when the base member is attached to the associated helmet exterior surface; and a head portion having a diameter greater than a diameter of the hollow post portion and disposed at a distal end of the hollow post portion;

wherein the threaded insert further comprises an internally threaded sleeve and an enlarged diameter portion and further wherein the cavity includes a bore receiving the internally threaded sleeve and a counterbore receiving the enlarged diameter portion.

2. The mounting cleat assembly of claim 1, wherein the base member, hollow post portion, and head portion cooperate to define an annular channel around the hollow post portion, the channel defining a first mounting interface.

3. The mounting cleat assembly of claim 2, wherein the threaded insert defines a second mounting interface.

4. The mounting cleat assembly of claim 1, wherein the internally threaded sleeve comprises one or more protrusions, said one or more protrusions configured to mechanically interface with the base portion.

5. The mounting cleat assembly of claim 1, wherein the internally threaded sleeve comprises a tapered shank.

6. The mounting cleat assembly of claim 1, wherein an inward facing surface of the base member has an irregular surface.

7. The mounting cleat assembly of claim 6, wherein the inward facing surface has a plurality of channels formed therein for receiving the adhesive.

8. The mounting cleat assembly of claim 1, wherein the base portion is formed of a first material selected from the group consisting of a metal, a polymer material, and a composite material.

9. The mounting cleat assembly of claim 8, wherein the threaded insert is formed of a second material, wherein the second material is harder than the first material.

10. The mounting cleat assembly of claim 1, wherein the base portion further comprises an extended base portion, said extended base portion having a bottom surface, wherein the bottom surface is generally concave.

11. The mounting cleat assembly of claim 1, wherein the base member is configured to be permanently bonded with the adhesive to the associated helmet exterior surface.

12. The mounting cleat assembly of claim 1, wherein the base portion further comprises a lip circumscribing a peripheral edge of the base portion.

13. The mounting cleat assembly of claim 12, wherein the base portion and the lip cooperate to define a cavity for receiving the adhesive.

14. The mounting cleat assembly of claim 1, further comprising a cover, the cover configured to removably attach to the mounting cleat assembly.

15. The mounting cleat assembly of claim 1, further comprising an accessory rail member.

16. The mounting cleat assembly of claim 15, wherein the accessory rail member comprises an accessory interface portion for attaching an accessory device.

17. The mounting cleat assembly of claim 15, wherein the accessory rail member is configured to removably attach to the mounting cleat assembly.

18. The mounting cleat assembly of claim 17, wherein the accessory rail member further comprises one or more helmet-facing receptacles, each said one or more helmet facing receptacles corresponding to the mounting cleat assembly.

19. The mounting cleat assembly of claim 18, the accessory rail member further comprising:

a first sidewall, said first sidewall configured to removably receive a first clip for retaining;

a second sidewall, said second sidewall opposite the first sidewall and configured to removably receive a second clip.

20. The mounting cleat assembly of claim 19, wherein each of the first and second clips comprises a pair of legs adjoined by a crown.

21. The mounting cleat assembly of claim 20, wherein the pair of legs of the first clip are configured to interface with the hollow post portion to secure the accessory rail member to the mounting cleat assembly.

22. The mounting cleat assembly of claim 19, wherein each of said first and second clips comprises a notch configured to receive a removal tool for facilitating removal of the first and second clips, respectively.

23. The mounting cleat assembly of claim 1, further comprising a helmet mount assembly, wherein the helmet mount assembly is configured to removably attach to the mounting cleat assembly.

24. The mounting cleat assembly of claim 23, wherein the helmet mount assembly further comprises one or both of:

a helmet mount interface secured to a frame, wherein the helmet mount interface is configured to removably attach a helmet mount; and one or more keyhole interfaces corresponding to the mounting cleat assembly.

25. The mounting cleat assembly of claim 24, wherein the helmet mount assembly further comprises a locking member, the locking member pivotally attached to the helmet mount assembly.

26. The mounting cleat assembly of claim 25, wherein the locking member further comprises a plurality of indents, the plurality of indents configured to adjustably engage a detent member.

27. The mounting cleat assembly of claim 26, wherein the locking member further comprises a slot configured to receive an adjustment tool for facilitating adjustment of the locking member.

28. The mounting cleat assembly of claim 1, further comprising:

a securing member, the securing member having a back surface, the back surface configured to couple to the associated helmet exterior surface via an adhesive bond.

29. The mounting cleat assembly of claim 28, further comprising an adhesive layer disposed between the back surface and the associated helmet exterior surface.

30. The mounting cleat assembly of claim 29, wherein the securing member has an upper portion and a lower portion.

31. The mounting cleat assembly of claim 30, wherein the adhesive layer is configured for application to the lower portion.

32. The mounting cleat assembly of claim 30, wherein the adhesive layer is configured for application to the upper and lower portions.

33. The mounting cleat assembly of claim 28, the securing member further comprising an aperture configured to engage the mounting cleat assembly to secure the mounting cleat assembly substantially between the securing member and the associated helmet exterior surface.

34. The mounting cleat assembly of claim 28, wherein the mounting cleat is formed of a first material selected from the group consisting of a metal, a polymer material, and a composite material.

35. The mounting cleat assembly of claim 34, wherein the threaded insert is formed of a second material, wherein the second material is harder than the first material.

36. The mounting cleat assembly of claim 28, wherein the securing member is formed of a sheet material.

37. The mounting cleat assembly of claim 28, wherein the securing member is formed of a polymer material.

38. The mounting cleat assembly of claim 28, wherein the securing member defines a channel configured to receive a brim of the helmet.

39. The mounting cleat assembly of claim 28, wherein the securing member defines a first generally U-shaped channel configured to receive an unfinished brim of the helmet and wherein the first generally U-shaped channel is further configured to be received within helmet brim piping, the helmet brim piping defining a second generally U-shaped channel, the helmet brim piping for finishing the unfinished brim of the helmet.

40. A helmet mount system for attaching a device to a helmet, the helmet mount system comprising:

a mounting cleat, the mounting cleat having an outer portion and a threaded insert received within a cavity formed in the outer portion; and the outer portion having an inward facing surface configured to receive an adhesive layer for coupling the inward facing surface to a surface of the helmet;

wherein the threaded insert further comprises a threaded sleeve and an enlarged diameter portion and further wherein the cavity includes a bore receiving the threaded sleeve and a counterbore receiving the enlarged diameter portion, and wherein the threaded sleeve comprises a tapered shank.

41. The helmet mount system of claim 40, the outer portion of the mounting cleat further comprising a flange portion, the flange portion further comprising a base portion, said base portion extending substantially distally from the mounting surface.

42. The helmet mount system of claim 41, wherein the base outer portion further comprises a post portion and a head portion, the post portion extending from the base portion, and the head portion having a diameter greater than a diameter of the post portion.

43. The helmet mount system of claim 41, further comprising a securing member, the securing member having a back surface, the back surface configured to couple to the associated helmet exterior surface via an adhesive bond.

44. The helmet mount system of claim 43, wherein the back surface comprises a first adhesive layer and an outward facing surface of the flange portion comprises a second adhesive layer for enhancing an adhesive bond between the flange portion and the second adhesive layer.

45. The helmet mount system of claim 44, wherein the threaded sleeve comprises a plurality of splines, said splines configured to mechanically interface with the mounting cleat.

46. The helmet mount system of claim 44, wherein the threaded sleeve comprises a tapered shank.

47. A helmet mount system for attaching a device to a helmet, the helmet mount system comprising:

a mounting cleat, the mounting cleat having an outer portion and a threaded insert received within a cavity formed in the outer portion;

the outer portion having an inward facing surface configured to receive an adhesive layer for coupling the inward facing surface to a surface of the helmet;

wherein the mounting cleat further comprises a base portion, said base portion including a post portion extending from the base portion, and a head portion, the head portion having a diameter greater than a diameter of the post portion; and wherein the base portion further comprises a lip circumscribing a peripheral edge of the base portion.

48. The helmet mount system of claim 47, wherein the base portion and the lip cooperate to define a cavity for receiving the adhesive layer.

* * * * *